US007165557B2

(12) United States Patent
Fukuyama

(10) Patent No.: US 7,165,557 B2
(45) **Date of Patent: *Jan. 23, 2007**

(54) HAIR-TRANSPLANTING APPARATUS AND METHOD AND RESULTING HAIR-TRANSPLANTED PIECE

(75) Inventor: Koki Fukuyama, Tokyo (JP)

(73) Assignee: Propia Co., Ltd., Tokyo (JP)

( * ) Notice: Subject to any disclaimer, the term of this patent is extended or adjusted under 35 U.S.C. 154(b) by 476 days.

This patent is subject to a terminal disclaimer.

(21) Appl. No.: 10/820,398

(22) Filed: Apr. 8, 2004

(65) Prior Publication Data

US 2004/0225314 A1 Nov. 11, 2004

(30) Foreign Application Priority Data

Apr. 10, 2003 (JP) ..... 2003-106796
Apr. 10, 2003 (JP) ..... 2003-106797

(51) Int. Cl.
*A41G 3/00* (2006.01)
*A41G 5/00* (2006.01)

(52) U.S. Cl. ..... 132/201; 132/53

(58) Field of Classification Search ..... 132/53, 132/201, 200, 56, 54
See application file for complete search history.

(56) References Cited

U.S. PATENT DOCUMENTS 1,199,144 A * 9/1916 Zak ..... 132/53
3,013,567 A * 12/1961 Sotzky ..... 132/201
3,467,110 A * 9/1969 Frishman et al. ..... 132/201
4,784,713 A * 11/1988 Van Nieulande ..... 131/245
5,921,253 A * 7/1999 Jeong ..... 132/201

FOREIGN PATENT DOCUMENTS

| | | |
|---|---|---|
| JP | 2001-303348 | 10/2001 |
| JP | 2001-303349 | 10/2001 |
| JP | 2003-105616 | 4/2003 |

* cited by examiner

*Primary Examiner*—John J. Wilson
*Assistant Examiner*—Robyn Doan
(74) *Attorney, Agent, or Firm*—Keusey, Tutunjian & Bitetto, P.C.

(57) ABSTRACT

A base sheet (11 ) of elastic material is stretched, and the intermediate portion of a hair segment is caught by reciprocating needles (41*a*) to form a shape-retainable turn (30*a*) at said intermediate portion. The turn remains on one side of the base sheet and secured to said one side with a first adhesive layer (111), whereas a pair of lengthwise hair extensions (30*b*) extending from the opposite ends of the turn pass through holes (11*a*), formed by penetration of the needles during elevation thereof, to beyond the other side of the base sheet. After a predetermined number of the hair segments are transplanted and secured to the base sheet, the stretched condition of the base sheet is released or loosened, so that it contracts due to elasticity to thereby reduce the diameter of the holes. Then, a second adhesive layer (112) is formed entirely on the said one side of the base sheet for fitting on human skin.

22 Claims, 17 Drawing Sheets

(A)

(B)

(A)

(B)

(A)

(B)

HAIR-TRANSPLANTING APPARATUS AND METHOD AND RESULTING HAIR-TRANSPLANTED PIECE

FIELD OF INVENTION

The present invention relates to wig manufacturing in general, and more particularly to a hair-transplanting apparatus and method. The present invention also relates to a resulting product or piece comprising a thin base onto which a number of hair segments are transplanted and secured, which may be a disposable base. Such product may be recognized as a wig, hairpiece, toupee, etc. However, the product in accordance with the present invention may be worn on any part of human body skin, including head, arm, shin, etc.

BACKGROUND ART

Traditional wigs are hand-made, and often expensive. A hand-made wig is typically manufactured in such a way that an artificial hair segment is folded in two, and hairs are one by one transplanted by handwork onto a three-dimensional, relatively thick base. When one folded hair segment is transplanted on the base, it looks as if two hairs are transplanted. To manufacture a wig with 20,000 hairs transplanted, this laborious task must be repeated 10,000 times. This, of course, considerably increases time and costs for manufacturing the wig.

Therefore, a need exists for an easily manufactured and inexpensive wig, which can be disposable.

SUMMARY OF INVENTION

Accordingly, it is a principal object of the present invention to overcome the drawbacks and disadvantages of the prior art wig manufacturing system.

Another object of the present invention is to manufacture a piece on which a number of hair segments are fixedly transplanted at reasonable cost.

Still another object of the present invention is to manufacture a hair-transplanted piece of a disposable type.

Still another object of the present invention is to manufacture a hair-transplanted piece which looks like the user's own hairs when fitted to any portion of human skin.

Still another object of the present invention is to provide a novel apparatus and method capable of transplanting hair segments substantially in upstanding condition with respect to a thin base sheet.

To achieve these and other objects, in accordance with aspects of the present invention, there is provided a hair-transplanting apparatus comprising a first supplying unit for supplying a base sheet of elastic material to a predetermined position; a base stretching unit for stretching the base sheet at the predetermined position; a second supplying unit for supplying a hair segment of a predetermined length to a first side of the base sheet; at least two reciprocating needles with hook ends having origins positioned below a second side of the base sheet, the needle hook ends piercing the base sheet to form holes and reaching beyond the first side of the base sheet during ascending movement of the needles, the needle hook ends catching an intermediate portion of the hair segment at the first side of the base sheet and then passing down through the holes to reach beyond the second side of the base sheet so that the intermediate portion of the hair segment caught by the hook ends remains on the first side of the base sheet, whereas a pair of lengthwise hair extensions extending from opposite sides of the intermediate portion pass through the holes to below the second side of the base sheet; a hair-curling unit for giving a shape-retainable turn at the intermediate portion of the hair segment which has been caught by the hook ends of the needle on the first side of the base; a first adhesive applicator for applying first adhesive to each of the turns of the hair segments remaining on the first side of the base sheet, thereby forming a first adhesive layer each surrounding the turn; and a second adhesive applicator for applying a second adhesive to all over the first side of the base sheet, including the first adhesive layers, to form a second adhesive layer; the needle, the hair-curling unit and the first adhesive applicator being operable while the base sheet is maintained stretched by the base stretching unit, the stretched condition of the base sheet being released or loosened after a predetermined number of the hair segments are transplanted to the base sheet by the needles and secured thereto by the first adhesive layers, followed by forming said second adhesive layer by the second adhesive applicator.

In one embodiment, the first supplying unit supplies the base sheet upside down, and the second supplying unit supplies the hair segment to above an underside of the base sheet.

The second supplying unit may comprise means for supplying a continuous, endless hair material in parallel with the base sheet, and a cutter for cutting the continuous, endless hair material when it is supplied by a predetermined amount, thereby obtaining the hair segment of predetermined length.

The second supplying unit may comprise a hair catcher including a pair of opposed inverted-triangular frames through which the artificial hair extends substantially horizontally, with a space therebetween for allowing insertion of the needle hook ends. Preferably, the hair catcher is rotatable and swingable about a vertical axis in synchronization with reciprocating movement of the needles.

The hair-curling unit may comprise a heater operable between the hair segment and the first side of the base sheet, the heater making contact with the intermediate portion of the hair segment when the hair segment carried by the needle hook ends is moved down, whereby the intermediate portion of the hair segment is heated to be partly molten or soften to form the turn of a given shape which remains unchanged after being solidified.

Preferably, the second adhesive applicator applies the second adhesive by transfer.

The apparatus may further comprise a base lifting member operable in synchronization with the needles for lifting the base sheet, remaining in a stretched condition by the base stretching unit, to keep the holes unclosed, thereby allowing smooth entry and passage of the needle hook ends through the holes when the needle hook ends returns to the original position (or origins) after catching the hair segment.

The apparatus may further comprise a hole repairing unit for injecting repairing liquid to the holes after the needle hook ends carrying the hair segment have separated from the base sheet.

In accordance with another aspect of the present invention, there is provided a hair-transplanting method comprising the steps of stretching a base sheet of elastic material; moving needles so that their hook ends pierce the base sheet to form holes and reach beyond a first side of the base sheet; returning the needles to their original position (or origins) beyond a second side of the base sheet, during which an intermediate portion of the hair segment is caught by the needle hook ends; transforming the hair segment to provide a shape-retainable turn at the intermediate portion of the hair segment, after the needle hook ends catch the hair segment but before the needle hook ends carrying the hair segment pass through the holes; forming first adhesive layers of first adhesive in a dot pattern on the first side of the base sheet around the shape-retainable turns to secure the shape-retainable turns onto the first side of the base sheet; repeating the needle moving step, the needle returning step, the transforming step and the turn-securing step until a predetermined number of the hair segments are transplanted and secured on the base sheet in such manner that the shape-retainable turn at the intermediate portion of the hair segment remains on the first side of the base sheet between the holes whereas a pair of lengthwise hair extensions extends from opposite ends of the shape-returnable turn through the holes to beyond the second side of the base sheet; releasing or loosening the base sheet from being stretched to contact the base sheet due to its elasticity and reduce diameter of the holes; and applying second adhesive to form a second adhesive layer entirely covering the first side of the base sheet for fitting on a human skin.

In one embodiment, the needle moving step comprises elevating the needles from the original position (or origins) below the second side of the base sheet, and the needle returning step comprises moving said needles down from their upper dead points toward said origins. In another embodiment, the needle moving step comprises moving the needles down from the origins positioned above the second side of the base sheet, and the needle returning step comprises elevating the needles from their lower dead points toward the origins.

The first adhesive layer may be formed by applying the first adhesive to the shape-retainable turn substantially at the same time or immediately after the transforming step is carried out to form the shape-retainable turn. The first adhesive may also be formed by applying in advance the first adhesive onto the first side of the base sheet between the holes formed by elevation of the needles and transferring the first adhesive to the shape-retainable turn when the shape-retainable turn makes contact with the first side of the base sheet during the needle returning step.

In accordance with still another aspect of the present invention, there is provided a hair-transplanted piece comprising a thin base sheet of elastic material; a predetermined number of hair segments transplanted onto the base sheet in such manner that an intermediate portion of each of the hair segment provides a shape-retainable turn remaining and lying on an underside of the base sheet between a pair of holes whereas a pair of lengthwise hair extensions extending from opposite ends of the turn and passing through the holes to orient far from a external surface of the base sheet; first adhesive layers in a dot pattern, each overlapping the turn of the hair segment and securing the same onto the underside of the base sheet; and a second adhesive layer entirely covering the underside of the base sheet, including the first adhesive layers, to provide a flat surface to be fitted onto human skin.

In one embodiment of the hair-transplanted piece according to the present invention, the base sheet comprises a plane sheet. The base sheet may be colorless and transparent.

A main component of the adhesive used to form the first adhesive layer is preferably identical to the base sheet material. By way of example, the base sheet is made from urethane-base material and the adhesive forming the first adhesive layer comprises urethane-base adhesive.

A main component of the adhesive used to form the second adhesive layer is preferably different from that of the adhesive used to form the first adhesive layer. By way of example, the adhesive used to form the first adhesive layer comprises urethane-base adhesive, whereas the adhesive used to form the second adhesive layer comprises acrylic-base adhesive.

The second adhesive layer is formed preferably by transfer.

Note that when the term wig is employed herein, the term covers any product with a number of hair segments transplanted and secured thereto for wearing or adhering to any part of human body skin.

BRIEF DESCRIPTION OF DRAWINGS

Other objects and advantages of the present invention can be understood from the following description when read in conjunction with the accompanying drawings in which:

FIG. 1 diagrammatically shows an example of a hairpiece embodying the present invention, wherein FIG. 1(A) is a perspective view of the hairpiece, FIG. 1(B) is an enlarged vertical cross-section showing a part designated by B in FIG. 1(A), and FIG. 1(C) is a further enlarged view showing a part designated by C in FIG. 1(B);

FIG. 2 shows an artificial hair transplanting operation in manufacturing of the hairpiece of FIG. 1, wherein FIG. 2(A) is an explanatory view showing a step of interconnecting an artificial hair with a base sheet and FIG. 2(B) is an explanatory view showing a succeeding step of securing the artificial hair to the base sheet with a first adhesive layer;

FIG. 5 diagrammatically shows an example of a tensioning/positioning unit of the apparatus of FIG. 3, wherein FIG. 5(A) is a plan view, FIG. 5(B) is a front view and FIG. 5(C) is a plan view showing a manner of stretching a base sheet with rollers;

FIG. 6 shows a head unit used in the apparatus of FIG. 3, wherein FIG. 6(A) is a front view and FIG. 6(B) is a left side view;

FIG. 9 shows, with an enlarged scale, a part indicated by a reference "IX" in FIG. 8, wherein FIG. 9(A) is a front view, FIG. 9(B) is a right side view and FIG. 9(C) is a plan view;

FIG. 10 shows a hair catcher used in the apparatus of FIG. 3 together with an artificial hair transplanting step, wherein FIG. 10(A) is a side view showing positional relation between the hair catcher and the needles where the artificial hair is caught by the needles, FIG. 10(B) is a front view showing the same positional relation with FIG. 10(A), FIG. 10(C) is a front view showing another positional relation where the needles carrying the artificial hair descends from their upper peak point to form, with a heater nozzle, a shape-retainable turn at an intermediate portion of the artificial hair, and FIG. 10(D) is a front view showing still another positional relation where the needle reaches the lower peak point;

FIG. 11 shows operation of a hair orientating unit used in the apparatus of FIG. 3, wherein FIG. 11(A) is an explanatory view showing an initial relation between the unit and the artificial hairs and FIG. 11(B) is an explanatory view showing a subsequent relation therebetween where the transplanted artificial hairs are oriented to a predetermined direction to form a large space below the base sheet, allowing smooth entry and separation with respect to the base sheet in the next transplanting operation;

FIG. 12 shows an electromagnetic valve used in the apparatus of FIG. 3, wherein FIG. 12(A) is a perspective view and FIG. 12(B) is a circuit diagram;

DETAILED DESCRIPTION OF PREFERRED EMBODIMENTS

Figure 1:
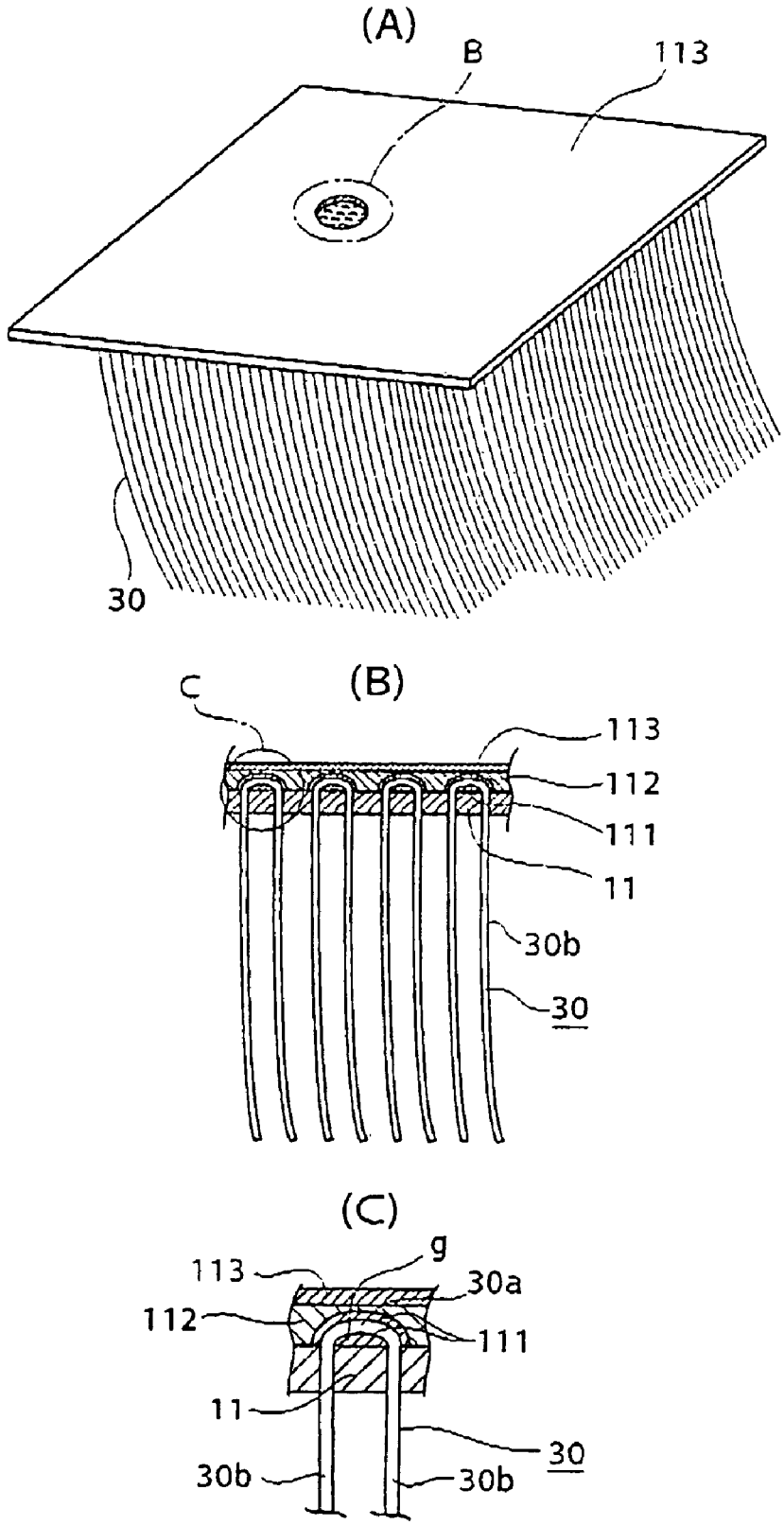

The present invention provides methods, systems and devices to manufacture inexpensive wigs. These wigs can be employed as disposable products.

In initial attempts to manufacture a disposable wig, the inventors tried to apply an adhesive by coating or spraying to the underside of a base to form an adhesive layer to be fitted onto a skin of a human body. However, the adhesive layer thus formed was relatively thick and its thickness was not uniform. When using such a wig, anyone can soon spot that he or she wears a wig, because a boundary between the hem of the wig base and the human skin is quite easy to observe.

Other attempts were made to use a very thin base sheet of thickness equivalent to human skin. However, it has often been found that a thin base sheet between adjacent two holes, formed by penetration of a pair of needles, could easily tear off to form a continuous slit, so that the hair-transplantation becomes infeasible.

This is because an excessive degree of tension should be applied to the thin base sheet during hair transplanting process, whereby the thin base sheet could be split by the root of the folded artificial hair when it is pulled away from the base sheet.

Another problem is that an adhesive layer of uneven thickness tends to cause the base sheet to wrinkle when the wig is fitted onto the human skin, which could be spotted that he or she wears a wig.

Still another problem is that, when a folded artificial hair is simply interconnected onto a wig base, it tends to lie down along the base. This is not preferable, because it looks just like a wig.

A disposable hairpiece and its manufacturing apparatus and method embodying the present invention will be described in more detail with reference to the accompanying drawings. Elements and parts having the same function are indicated by the same reference numerals throughout the drawings and explanation thereof will not be repeated.

First, one concept underlying the present invention will be outlined as follows. A base sheet 11 is made from an elastic material, which expands when stretched and restored to its original state when the stretched condition is removed. It is to be noted that base sheet 11 is shown in the drawings upside down, so that the underside is shown at an upper side of base sheet 11 and the external surface is shown at a lower side thereof. The supplied base sheet 11 is stretched. Then, each artificial hair 30 is subjected to a curling or transforming step to provide a shape-retainable turn 30*a* at an intermediate portion of artificial hair 30. The intermediate turn 30*a* of each artificial hair 30 is positioned on an underside of base sheet 11, while a pair of opposite lengthwise hair extensions 30*b*, extending from opposite ends of turn 30*a* are drawn toward and beyond an external surface of base sheet 11, as shown in FIG. 2(A).

Figure 2:
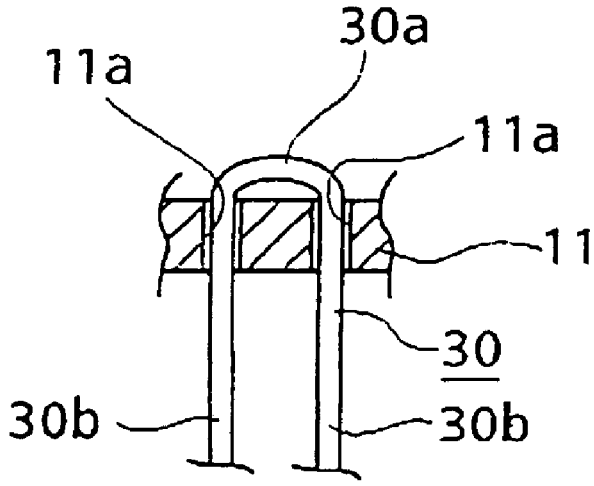
Figure 2:
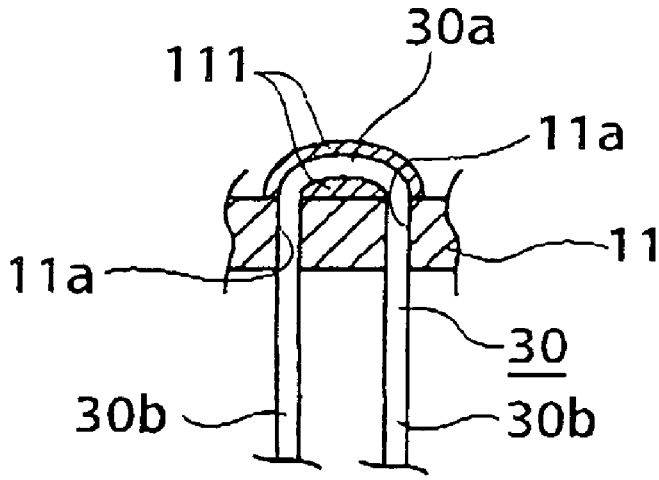
Figure 14:
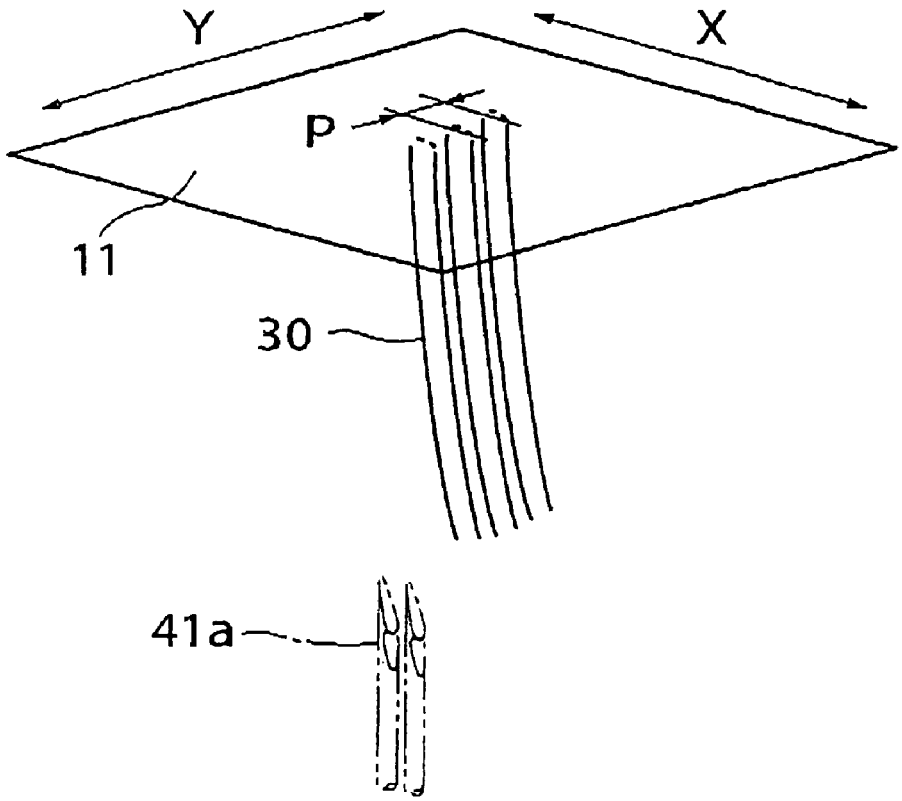
FIG. 14 is a perspective view showing the base sheet on which the artificial hairs have been transplanted with a predetermined pitch.

Then, as shown in FIG. 2(B), while keeping the stretched condition of base sheet 11, an adhesive is applied onto the intermediate turn 30*a* of each artificial hair 30 to form first adhesive layer 111 which fixedly bonds the intermediate turn 30*a* to the underside of base sheet 11. These steps are repeated so that a predetermined number of artificial hairs 30 are transplanted and secured onto base sheet 11, as shown in FIG. 14. Then, as shown in FIG. 1(C), another adhesive is applied onto the entire underside of base sheet 11 to form a second adhesive layer 112, which provides a flat surface. The first adhesive layers 111 are formed in a dot pattern on base sheet 11 at the respective position of turns 30*a*. The first adhesive layers 111 are entirely covered with the second adhesive layer 112. A separator 113 is layered on the second adhesive layer 112, which is in use removed to expose the second adhesive layer 112 for fitting the hairpiece to a human skin.

FIGS. 1(A)–1(C) show an example of a disposable hairpiece in accordance with the present invention. In this example, a base sheet 11 is made from a colorless, transparent, thin sheet of polyurethane having 20–30 micrometer thickness that is equivalent to that of a horny layer of a human skin. Each artificial hair 30 is made from thermoplastic resin such as acrylic fiber. Each artificial hair 30 is folded in two to form a curling turn 30*a* at the middle of length of the artificial hair 30. The turn 30*a* is formed to substantially retain its shape, which may be letter U shape as shown. The artificial hair 30 is interconnected with base sheet 11 in such manner as shown in FIG. 2(A) wherein the turn 30*a* lies on the underside of base sheet 11 and a pair of opposite lengthwise hair extensions 30*b* extends through holes or apertures 11*a*, 11*a* formed apart from each other with a predetermined distance. The hair extensions 30*b* further extends to beyond the external surface of base sheet 11. The adhesive swell or layer 111 comprises polyurethane-base adhesive, which surrounds each turn 30*a* of artificial hair 30 to fixedly bond the same to the underside of base sheet 11. The adhesive layer 112 comprises acryl-base adhesive, which is formed on the entire underside of base sheet 11, which is dotted with the first adhesive layers 111.

Figure 3:
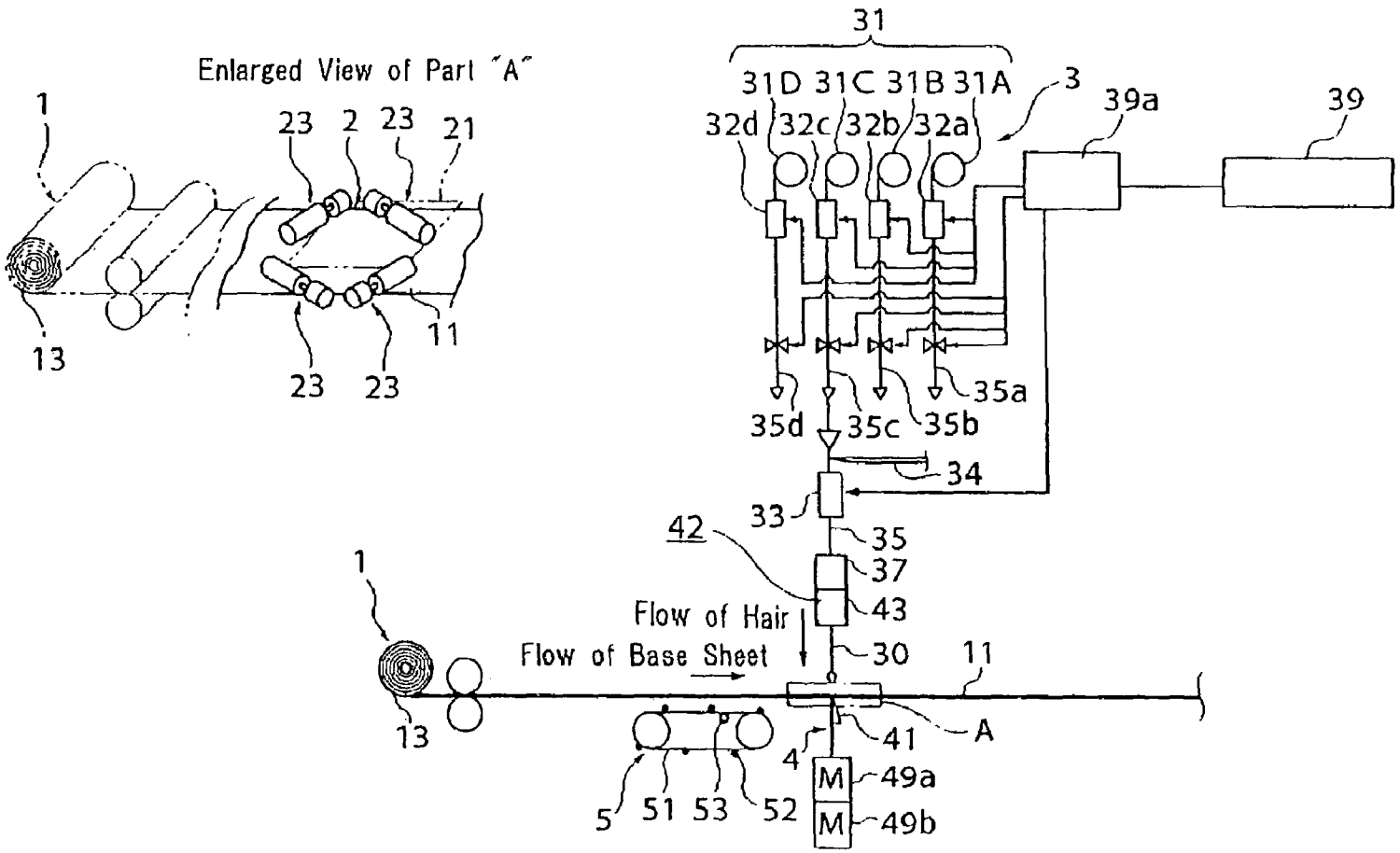
FIG. 3 is an explanatory view illustrating operation flows of a hairpiece manufacturing apparatus and method embodying the present invention, including an enlarged view of a part designated by a reference "A"
Figure 4:
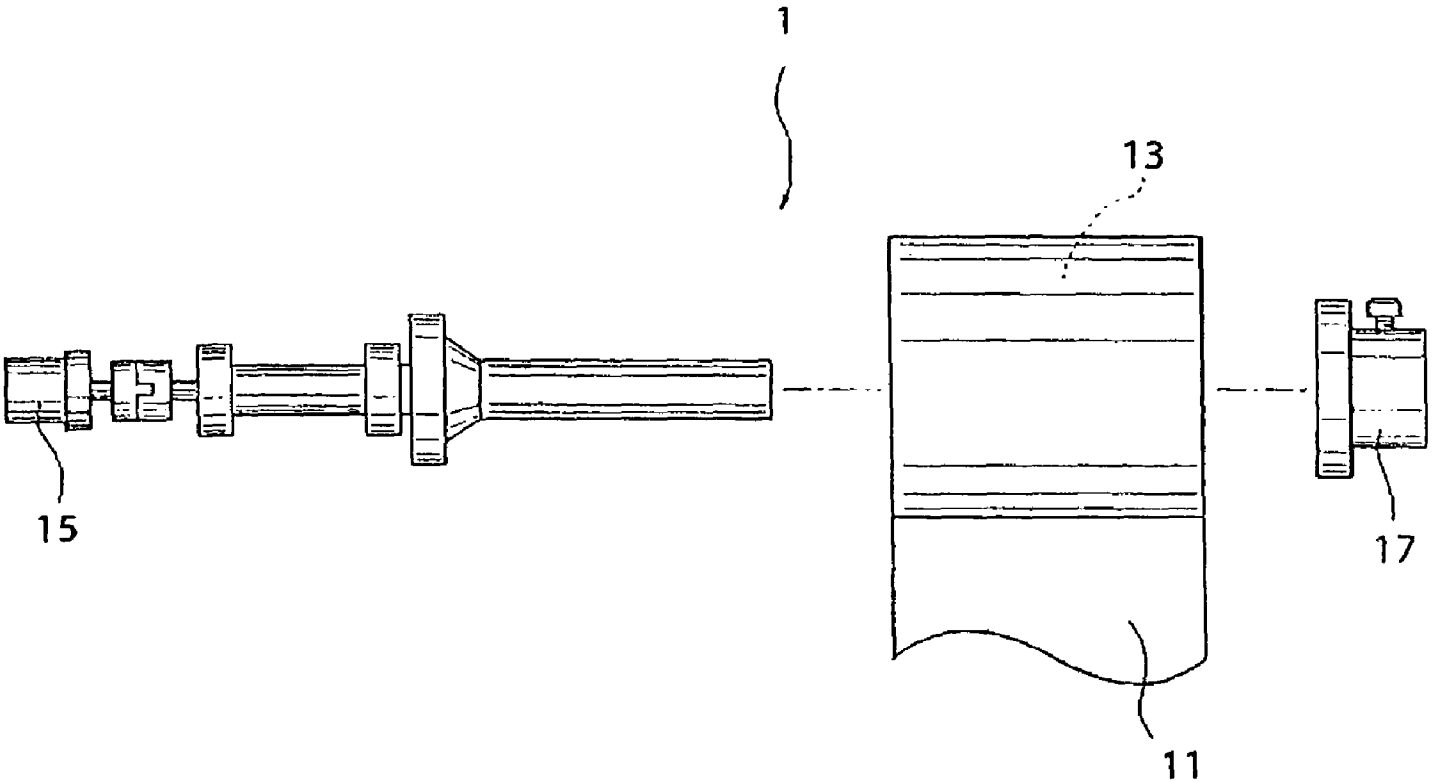
FIG. 4 is a front view showing a base sheet supplying unit of the apparatus of FIG. 3.

The disposable hairpiece manufacturing apparatus and method according to the present invention will be hereinbelow described in more detail. First, with reference to FIG. 3, base sheet 11 is horizontally supplied from a base sheet supply source 1 to a tensioning/positioning unit 2. For example, base sheet 11 is a colorless, transparent, plane sheet of polyurethane of a thickness of 0.03 mm. Base sheet 11 is wound around a sheet roll 13 in the form of an endless, continuous sheet. As shown in FIG. 4, the sheet roll 13 is driven by a motor 15 to supply an endless base sheet 11 therefrom onto a conveyor table 21. A reference numeral 17 indicates a stopper for preventing removal of the sheet roll 13.

Figure 5:
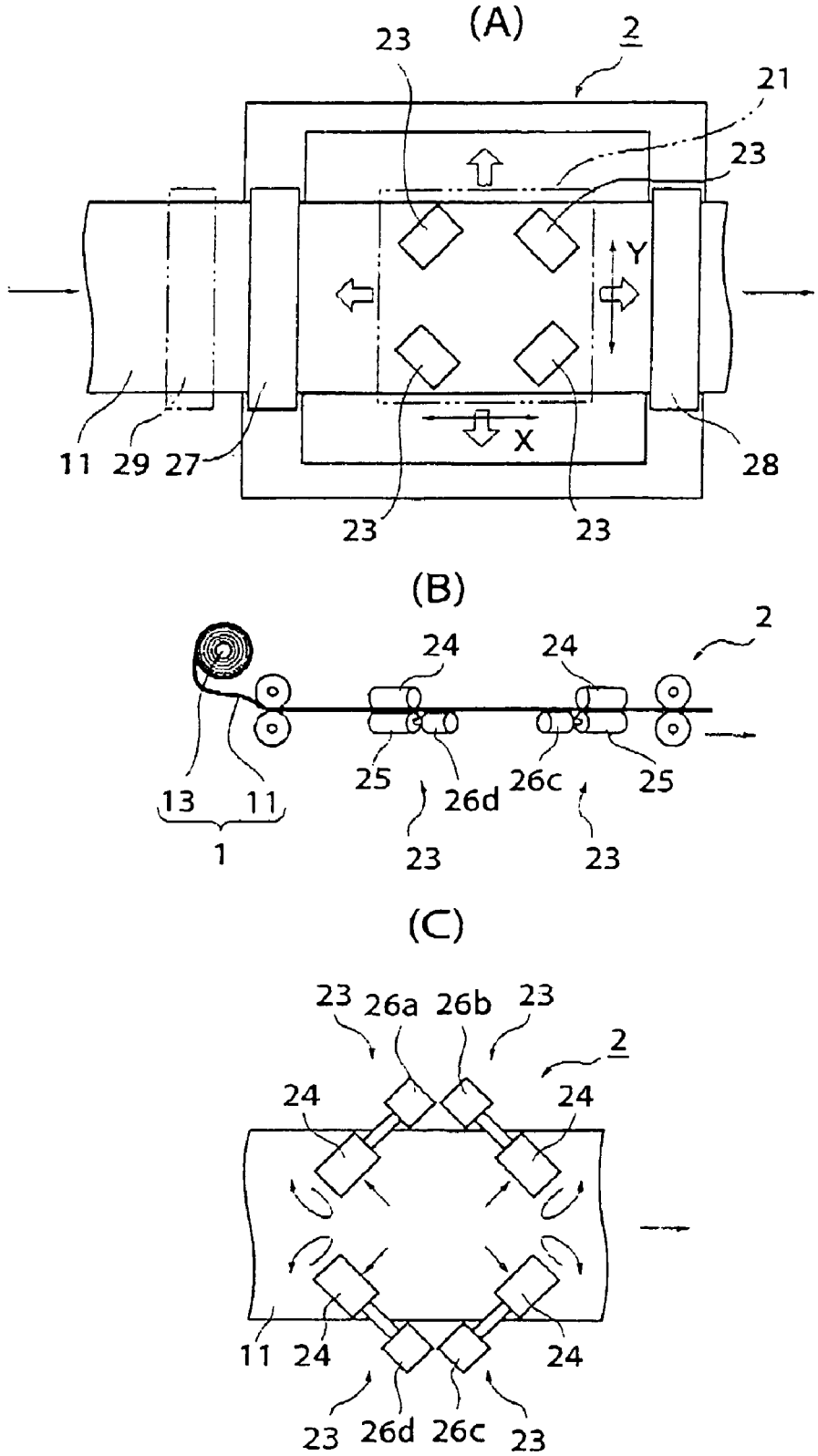

FIG. 5 shows the tensioning/positioning unit 2. The tensioning/positioning unit 2 has the conveyor table 21 movable, with a predetermined pitch "P" (FIG. 14), on a two-dimensional plane along X and Y axes which are perpendicular to each other. Table 21 is intermittently driven by X-axis and Y-axis motors, both not shown, to move in X and Y directions over a predetermined pitch "P" of 1 mm, for example. An artificial hair 30 is transplanted onto base sheet 11 supplied onto table 21 while table 21 remains in a fixed position. Thereafter, table 21 is moved to a different position for the next artificial hair transplanting operation. This is repeated until a predetermined number of artificial hairs 30 are transplanted onto base sheet 11.

Figure 15:
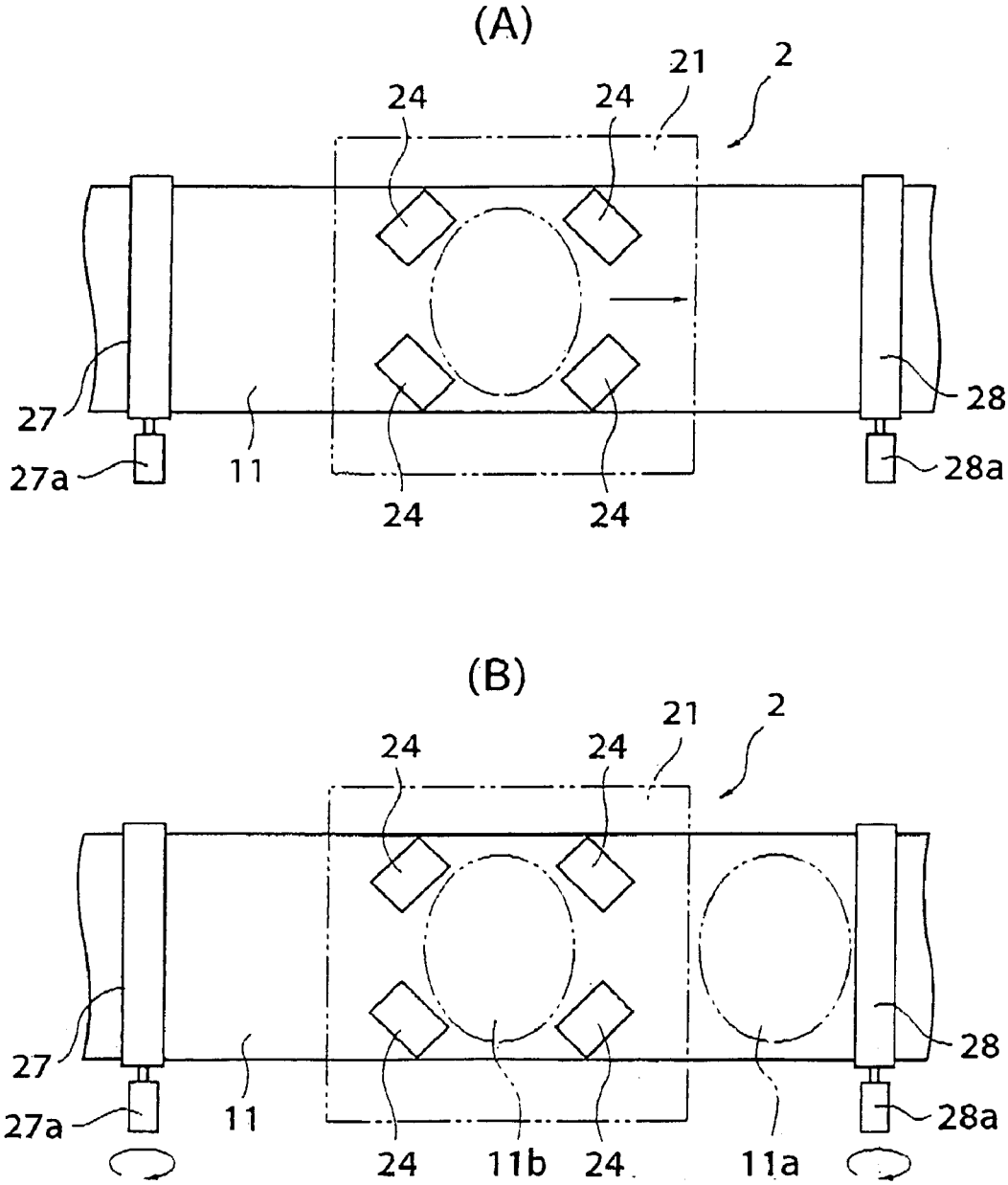
FIGS. 15(A)–(B) are plan views for explanation of how to move the base sheet on which the artificial hairs have been transplanted so that the apparatus is ready to restart the artificial hair transplanting operation with respect to a fresh base sheet.

There are tension rollers 23 at four corners on table 21 for tensioning and stretching base sheet 11 which has been supplied to a predetermined position on table 21. Each tension roller 23 comprises a pair of opposed tension nip rollers 24, 25 and a tension motor 26 (26*a*, 26*b*, 26*c*, 26*d*) for driving nip roller 24, 25 to rotate in forward and reverse directions. A reference numeral 27 indicates a pair of opposed feeder rollers (of which only an upper one is shown in FIG. 5(A)) arranged at the base sheet supply side or inlet of unit 2, which is driven by a motor 27*a* (FIG. 15) to rotate in a predetermined direction for supplying base sheet 11 onto table 21. A reference numeral 28 indicates a pair of opposed discharge rollers 28 (of which only an upper one is shown in FIG. 5(A)) arranged at the base sheet discharge side or outlet of unit 2, which is rotatable in opposite directions by a motor 28*a* (FIG. 15). A slack sensor 29 is mounted upstream of feeder rollers 27 for detecting a slack of base sheet 11 to be supplied to unit 2.

An artificial hair supplying unit 3 includes bobbins 31A, 31B, 31C and 31D (which may be hereinlater referred to by numeral 31), each carrying a continuous artificial hair 30, and supplies artificial hair 30 to above base sheet 11. Artificial hairs of different colors are reeled around the respective bobbins 31. Each bobbin 31 is rotated by a separate motor, not shown, to provide a predetermined length of artificial hair 30. Artificial hair 30 is supplied by operation of a separate vacuum generator 32 (32*a*, 32*b*, 32*c*, 32*d*). One of vacuum generators 32 may cooperate with an additional, downstream vacuum generator 33 to unreel a predetermined length of artificial hair 30 of a selected color from a corresponding one of bobbins 31. Each bobbin 31 is connected to a separate conduit 35*a*, 35*b*, 35*c*, 35*d*, which are all connected to a single conduit 35. Artificial hair 30 is supplied through one of exclusive conduits 35*a*, 35*b*, 35*c*, 35*d* and then through the common conduit 35 to an artificial hair transplanting unit 4. As shown in FIG. 3, between the outlets of exclusive conduits 35*a*, 35*b*, 35*c*, 35*d* and the inlet of common conduit 35, there is a swingable hair cutter 34 driven by a motor, not shown, for cutting artificial hair 30 to a predetermined length during conveyance thereof from bobbin 31 to hair transplanting unit 4. For allowing cutter 34 to swing across the respective travel path of artificial hairs 30, there is a gap between the outlets of exclusive conduits 35*a*, 35*b*, 35*c*, 35*d* and the inlet of common conduit 35. Artificial hair is supplied as an endless hair through conduit 35 to unit 4 and then cut to a predetermined length.

Figure 6:
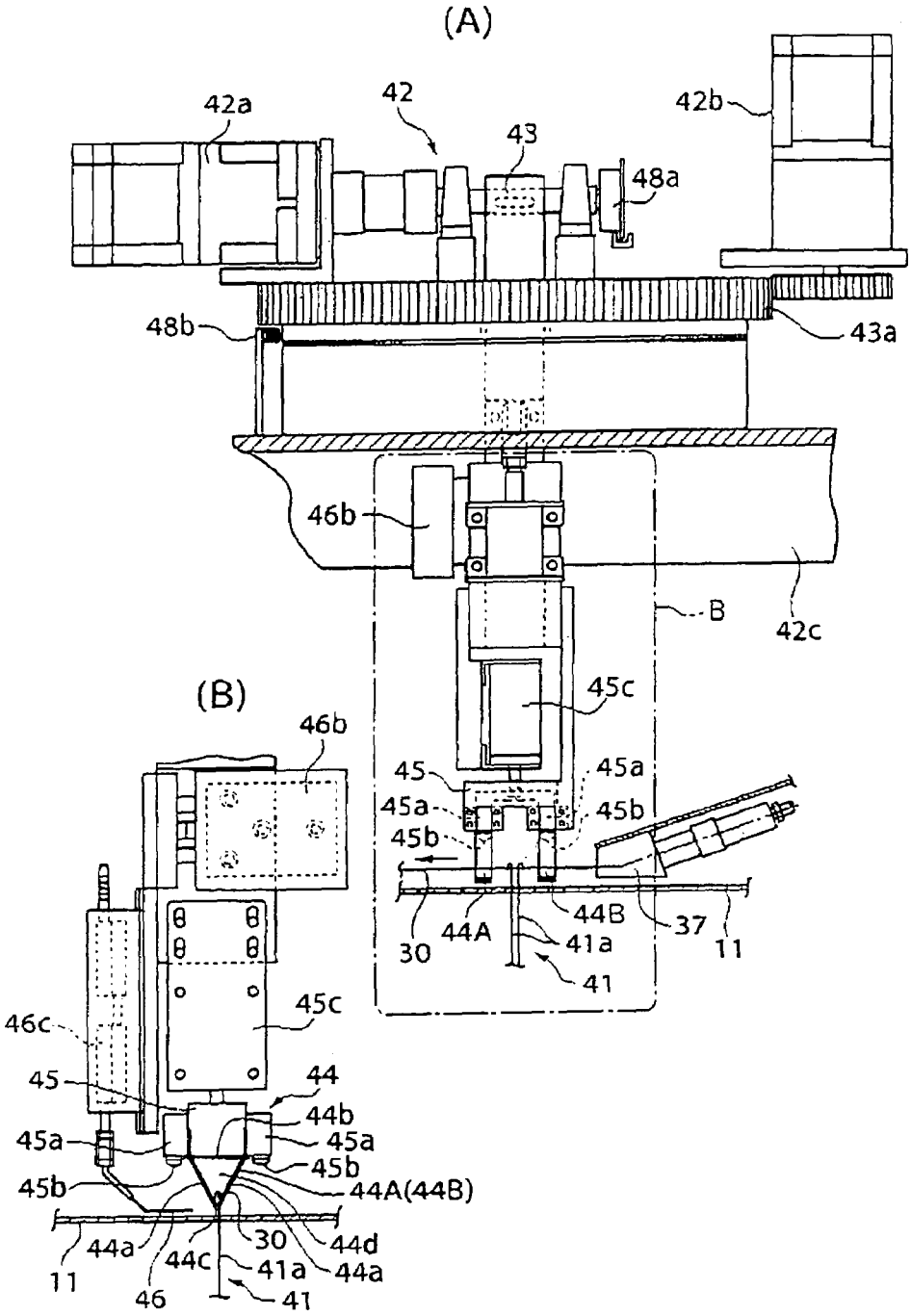
Figure 7:
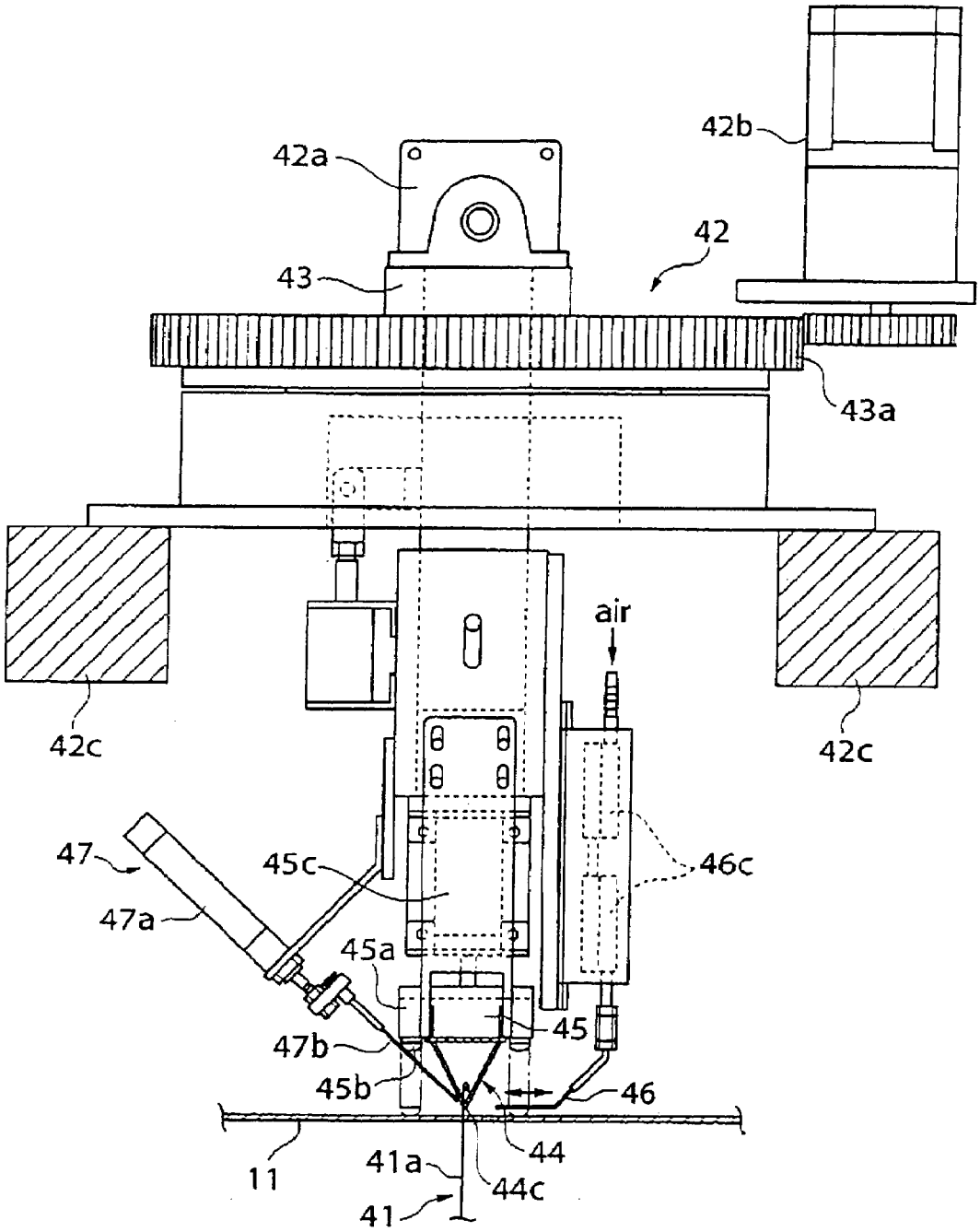
FIG. 7 is a back view of the head unit of FIG. 6.
Figure 8:
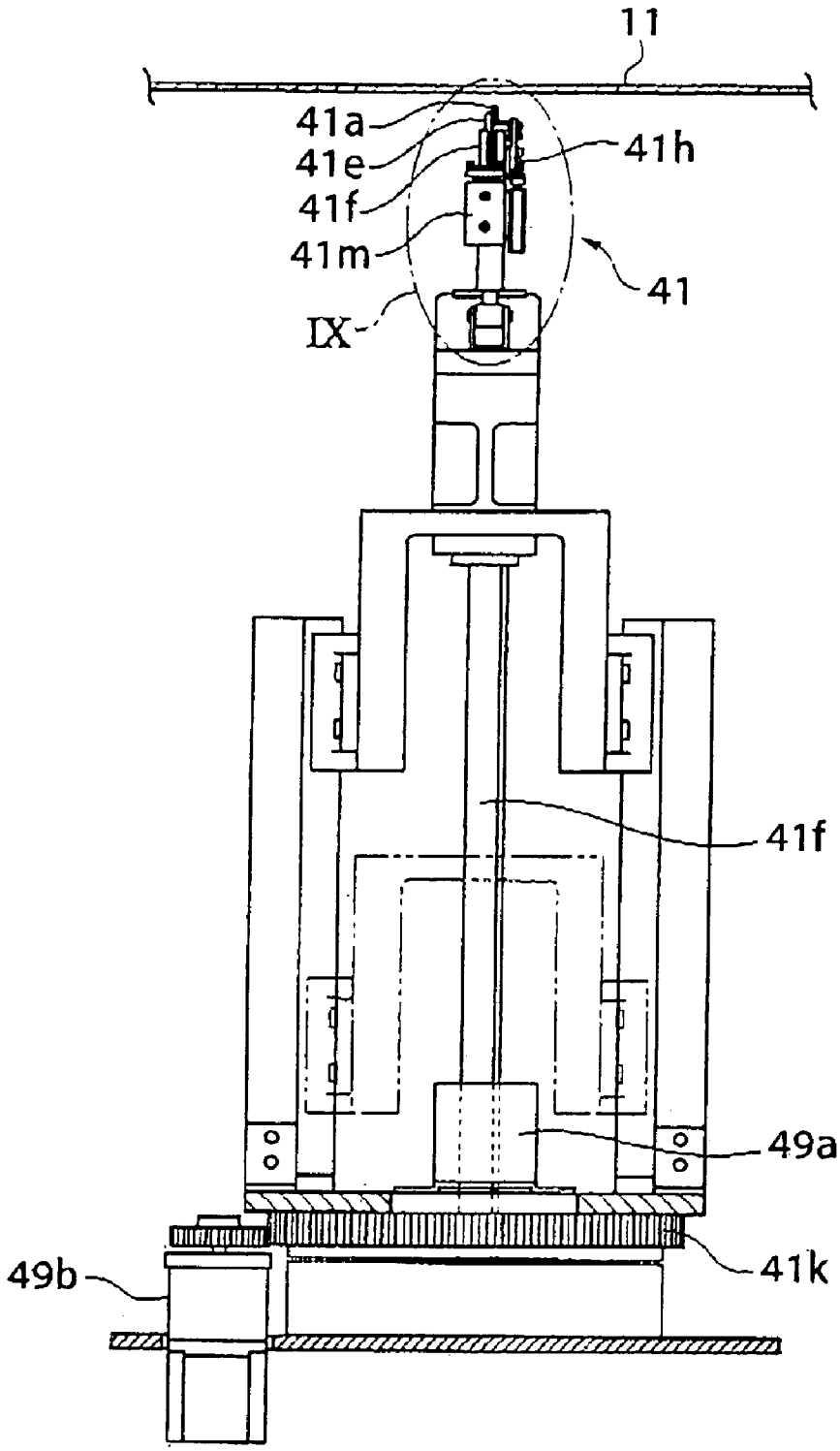
FIG. 8 is a front view showing a needle assembly used in the apparatus of FIG. 3.
Figure 9:
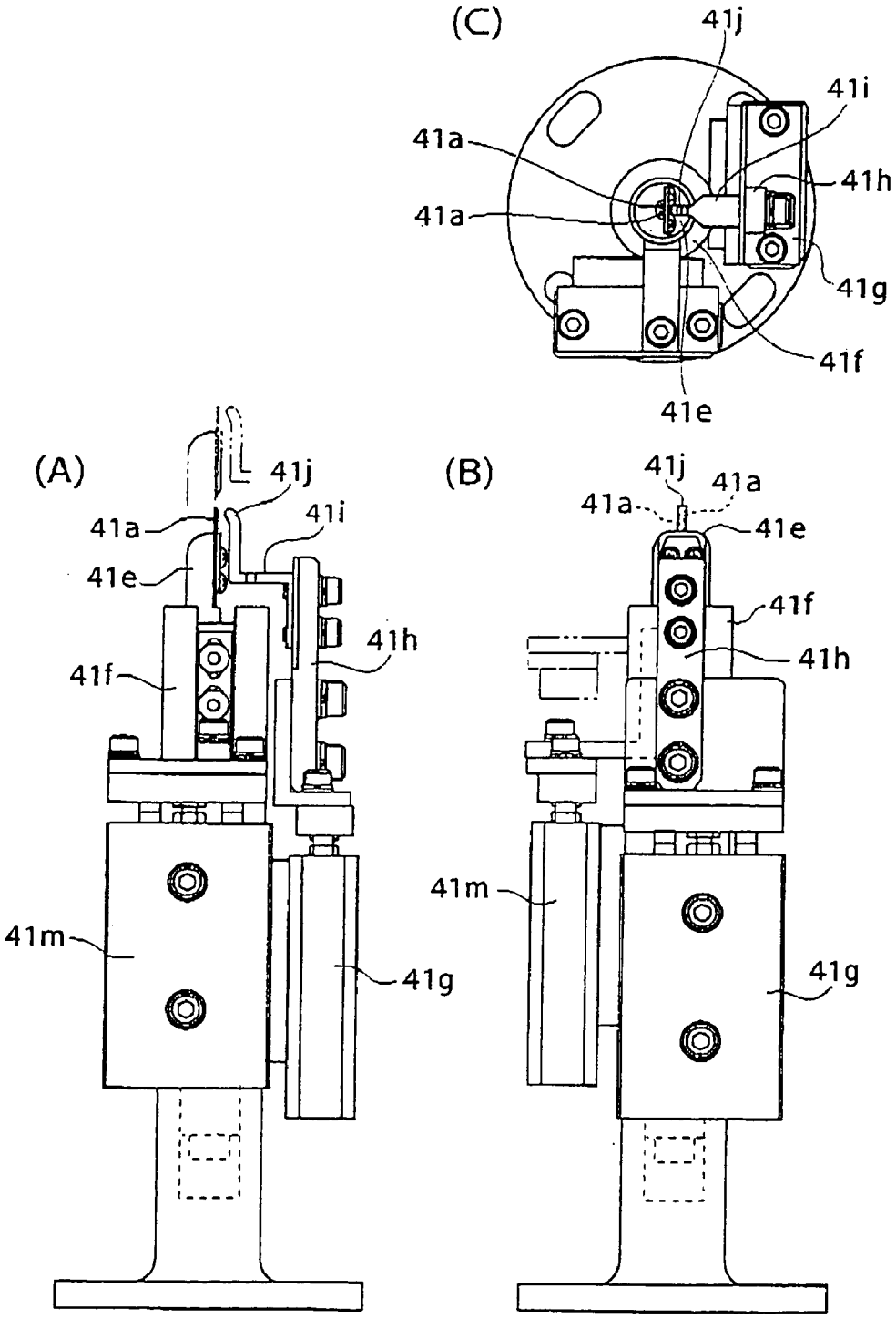

The hair transplant unit 4 is shown in detail in FIGS. 6–9. This unit 4 comprises a needle assembly 41 positioned beneath base sheet 11 and a head unit 42 positioned above base sheet 11 in opposition to needle assembly 41. As shown in FIGS. 8 and 9, needle assembly 41 includes a reciprocating needle shaft 41*e*. As best seen in FIG. 9(C), a pair of needles 41*a*, 41*a* are mounted on a top of needle shaft 41*e* with a predetermined space therebetween. For instance, there is a 1 mm space between the center axes of needles 41*a*, 41*a*. Each needle 41*a* has an extending superfine needle body with an acute end 41*b*. The outer edge of acute end 41*b* is provided with a cutter 41*c* which is useful to form a hole 11*a* when needle 41*a* pierces base sheet 11 during its ascending movement. The inner edge of acute end 41*b* provides an engaging hook 41*d* for engaging, catching and entraining an intermediate portion of artificial hair 30.

As shown in FIG. 9, needle shaft 41*e* is received in a holder 41*f* which is elevatable by a motor 49*a* (FIG. 3). Also, needle shaft 41*e* itself is elevatable with respect to holder 41*f* by a cylinder 41*m*. In opposition to needle shaft 41*e* is mounted a supporting member 41*h* which is elevatable by a cylinder 41*g*. To the upper end of supporting member 41*h* is connected to a horizontally extending base supporter 41*i* having an upstanding arm with an inwardly slanting end or base lifting member 41*j*. Supporter 41*i* begins to elevate substantially at the same time when needle 41*a* begins to move down from the upper peak position, so that the upper end member 41*j* pushes upwardly base sheet 11 at an area close to a hole 11*a* which has been formed in base sheet 11 by needle 41*a* during its ascending movement. The hole 11*a* is, therefore, enlarged, as specifically shown in FIG. 17. Thus, base sheet 11 is supported by base supporter 41*i* to prevent the descending needle 41*a* from becoming engaged with base sheet 11, which also prevents base sheet 11 in an area between adjacent two holes 11*a*, 11*a* from tearing off. If the needle 41*a* should dash against base sheet 11 during the descending movement of needle 41*a* carrying artificial hair 30 from the upper peak point toward the lower peak point, base sheet 11 could tear off between two adjacent holes 11*a*, 11*a* to form a continuous slit, which makes the artificial hair transplantation infeasible.

Referring now to FIGS. 6 and 7, head unit 42 has a post 43 and a hair catcher 44 at the lower end of post 43. Head unit 42 is driven by a motor 42*a* to swing like a pendulum on a plane of base sheet 11, describing a predetermined arc. Another motor 42*b* rotates an upper disc 43*a* so that head unit 42 including catcher 44 rotates about a vertical axis of post 43. A reference numeral 42*c* indicates a frame for attachment of head unit 42. A rotation angle sensor 48*a* comprises an encoder for detecting a rotation angle or position of head unit 42 in its swinging arc. Another rotation angle sensor 48*b* also comprises an encoder, which detects a rotation angle or position of head unit 42 in its axial rotation. A motor 49*a* is provided for elevation of needle shaft 41*e*, and another motor 49*b* operates in synchronization with motor 42*b* to rotate a lower disc 41*k*, so that needle shaft 41*e* with needles 41*a* rotates about a vertical axis of post 43. In FIG. 6, artificial hair 30 is supplied to base sheet 11 in a direction (X) shown by an arrow in FIG. 6A.

Figure 10:
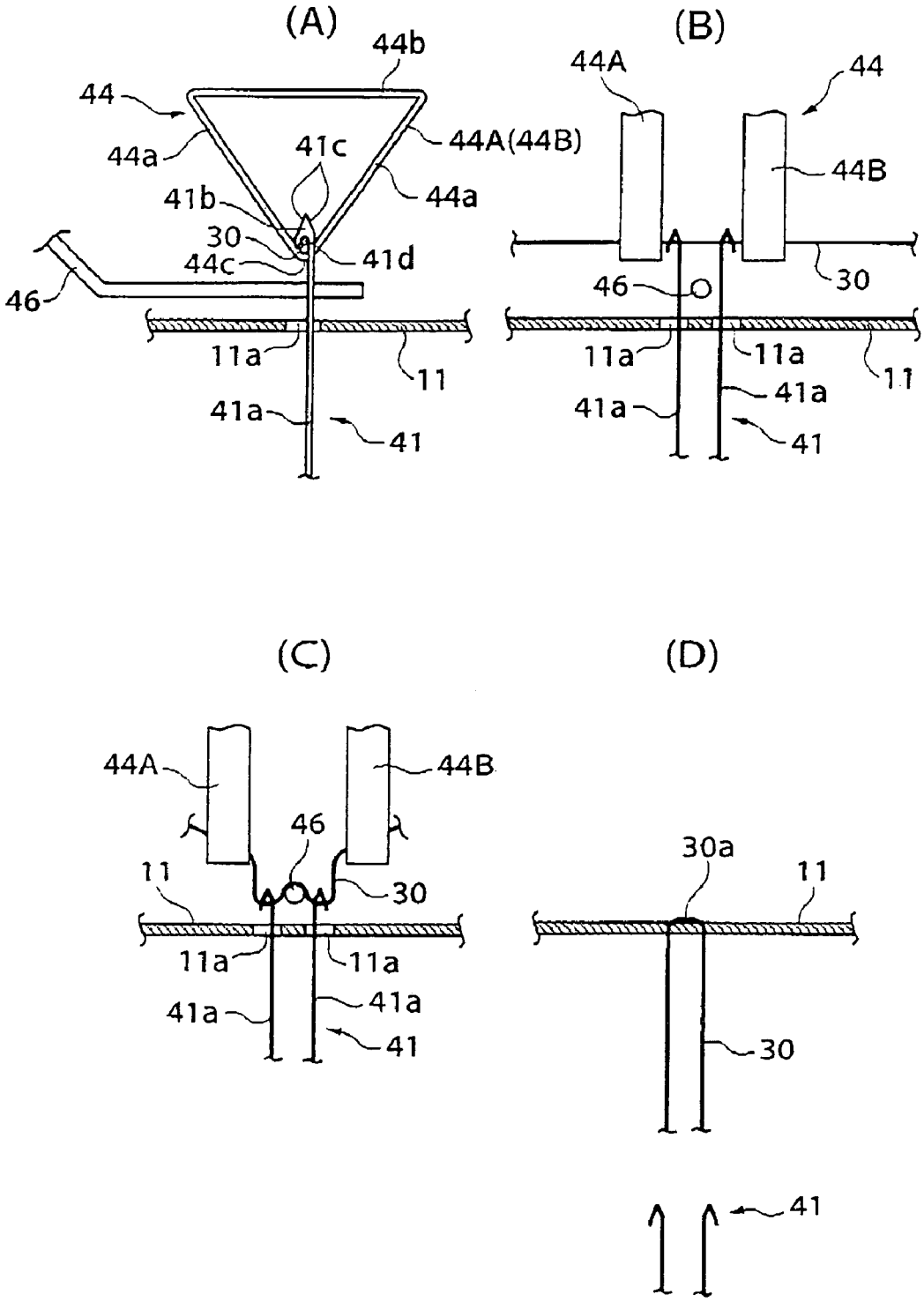

As best seen in FIG. 10, catcher 44 includes a pair of opposed inverted triangular frames 44A, 44B, each having an interior space 44*d* (FIG. 6(B)) for allowing insertion of artificial hair 30. Each frame 44A, 44B comprises an upper horizontal side 44*b* and a pair of oblique sides 44*a*, 44*a* extending from the opposite ends of the upper horizontal side 44*b* and intersecting with each other at their lower ends to form a lower apex 44*c*. After being discharged from a nozzle 37 (FIG. 3) arranged near the outlet of conduit 35, artificial hair 30 is supported horizontally by catcher frames 44A, 44B and extends through the interior space 44*d* enclosed by frames 44A, 44B. Frames 44A, 44B are secured to a rectangular boss 45 having four telescoping rods 45*a* with semi-spherical feet 45*b* at the lower ends thereof, respectively. Feet 45*b* become contact under pressure with base sheet 11, when rods 45*a* are driven by a cylinder 45*c* to extend downward as shown by imaginary lines in FIG. 7, to maintain the stretched condition of base sheet 11.

A nozzle 46 with small apertures (not shown) is connected to a heater 46*c* wherein an atmospheric air is heated to a predetermined temperature to create hot air, which is injected through the apertures of nozzle 46 against the intermediate portion of artificial hair 30 caught by hook ends 41*d*, 41*d* of needles 41*a*, 41*a* between frames 44A, 44B of hair catcher 44. Heater 46*c* is connected to a cylinder 46*b* so that nozzle 46 can extends horizontally from its stand-by position shown in FIG. 6(B) and FIG. 7 to its operable position shown in FIG. 10(A). A reference numeral 47 in FIG. 7 indicates a repairing liquid supplying unit with a cylinder 47*a* and a nozzle 47*b*. Nozzle 47*b* may be driven by cylinder 47*a* to extend to a vicinity of lower apex 44*c* of catcher frames 44A, 44B, as shown in FIG. 7, for supplying repairing liquid to base sheet 11 to repair each hole 11*a*.

Figure 11:
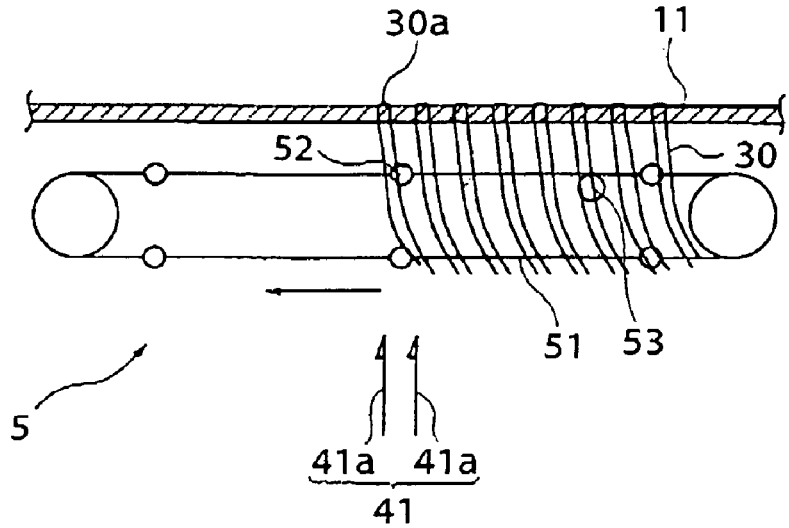
Figure 11:
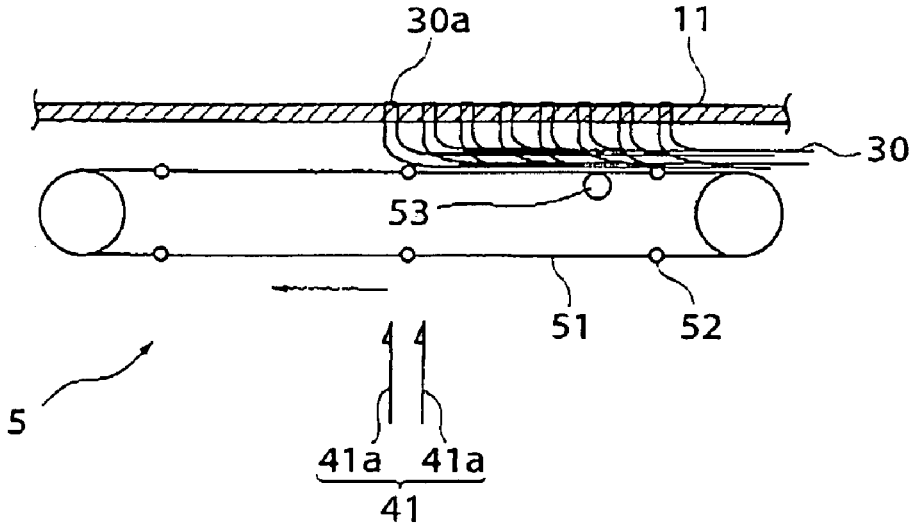

FIG. 11 shows a hair-orienting unit 5 including a chain conveyor 51 arranged below base sheet 11 to which artificial hairs 30 have been transplanted. Conveyor 51 has a plurality of engaging bars 52 at predetermined intervals and a plurality of retainer bars 53 at predetermined intervals greater than the interval of engaging bars 52. Conveyor 51 is intermittently driven to rotate in a direction shown by an arrow in FIGS. 11A and 11B. As conveyor 51 rotates, the transplanted artificial hairs 30 are engaged by engaging bars 52 to orient in a predetermined direction (i.e., to the right in this embodiment), as shown in FIG. 11(A), and then retained by retainer bars 53 into a bundle of artificial hairs 30, as shown in FIG. 11(B). This eliminates obstacles to the vertical movement of needles 41*a*, 41*a* and becomes ready for the next artificial hair transplanting operation.

Figure 12:
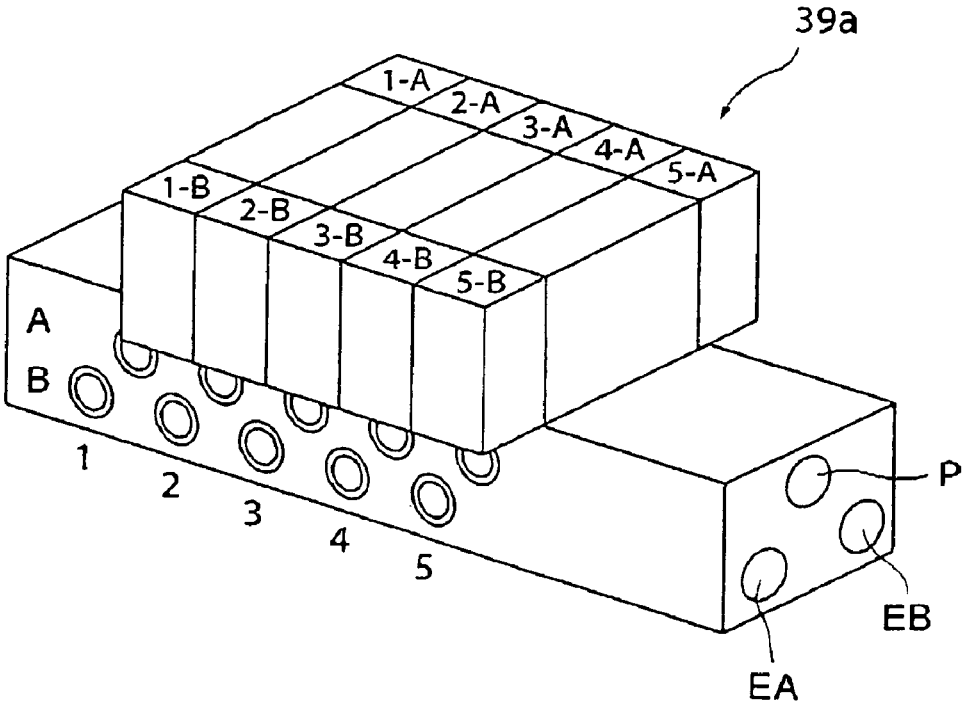
Figure 12:
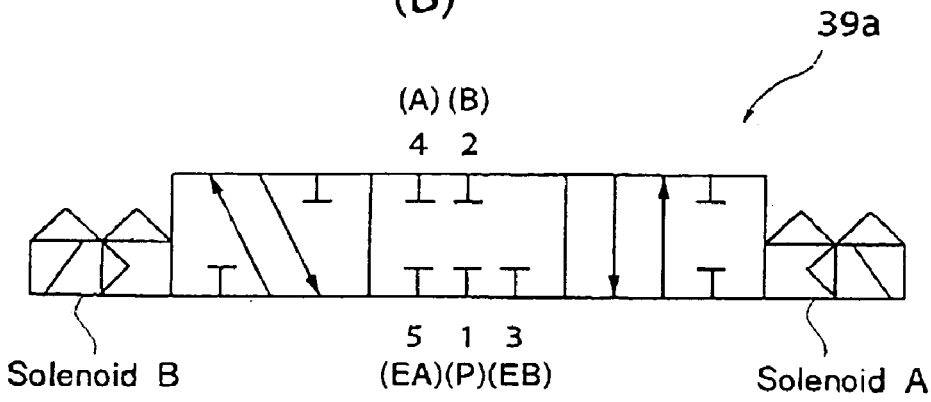
Figure 13:
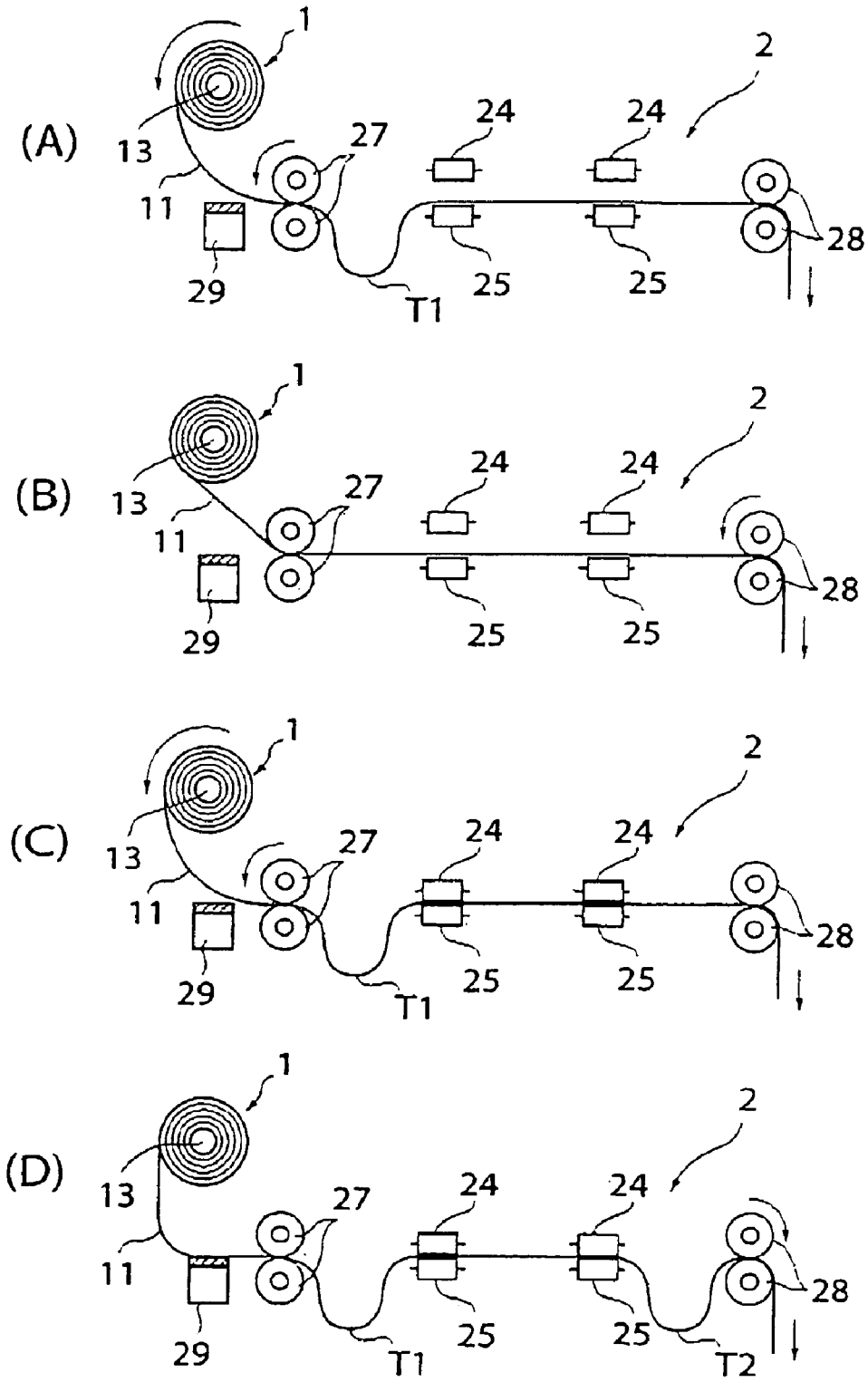
FIGS. 13(A)–(D) are views for explanation of how to create slack in the base sheet in a sequential manner.

Shown in FIG. 12 is an electromagnetic valve (three-position closed center double solenoid) 39*a* which operates in synchronization with an air compressor 39 to activate the vacuum generators 32, 33.

Operation of the apparatus will now be described in detail with reference to FIGS. 13–17. Slack T1 is first given to base sheet 11 at a point between feeder rollers 27 and tension nip rollers 24, 25 (FIG. 13(A)), and discharge rollers 28 are rotated to feed base sheet 11 (FIG. 13(B)). Up to this time, tension nip rollers 24 and 25 are separate from each other. Then, nip rollers 24, 25 are closed so that base sheet 11 is interposed therebetween, thereby again providing slack T1 between feeder rollers 27 and tension nip rollers 24, 25 (FIG. 13(C)). Discharge rollers 28 are then driven to rotate in a reverse direction to provide another slack T2 between tension nip rollers 24, 25 and discharge rollers 28 (FIG. 13(D)). The total amounts of slack T1 and slack T2 should be enough to move conveyor table 21 over a predetermined amount. In FIGS. 13(A)–13(D), the hatched area of sensor 29 indicates an area capable of detection. Base sheet 11 is transferred from the left to the right in these drawings.

Base sheet 11 is nipped between tension nip rollers 24, 25 into a stretched, unwrinkled condition on conveyor table 21, as shown in FIGS. 5(A)–5(C). Hair transplanting operation is controlled in accordance with a predetermined program stored in a control unit, that is a computer, not shown, for determining the transplant pitch "P" and the coloring of artificial hair 30 to be supplied to base sheet 11, etc. The color scheme of artificial hair 30 is determined by a given combination of hairs to be unreeled from the respective bobbins 31A–31D. By way of example, a combination of 50% of the hair from the bobbin 31A, 30% from the bobbin 31B, 15% from the bobbin 31C and 5% from the bobbin 31D will give a specific color to artificial hair 30 to be transplanted by unit 4.

Before starting hair-transplanting operation by unit 4, artificial hair 30 has already been supplied to above base sheet 11. This is carried out by vacuum generators 32, 33 which are driven in response to a command from the control unit to absorb artificial hair 30 toward unit 4. More specifically, when artificial hair 30 of a specific color reeled around bobbin 31A is to be selected, ports "1-A" and "2-A" of electromagnetic valve 39*a* (FIGS. 12(A) and 12(B)) in vacuum generator 32 are turned on, and a motor for rotation of bobbin 31A is energized. When artificial hair 30 of another color reeled around bobbin 31B is to be selected, ports "1-B" and "2-B" of electromagnetic valve 39*a* in vacuum generator 32 are turned on, and another motor for rotation of bobbin 31B is energized. When artificial hair 30 of still another color reeled around bobbin 31C is to be selected, ports "3-A" and "4-A" of electromagnetic valve 39*a* in vacuum generator 32 are turned on, and still another motor for rotation of bobbin 31C is energized. When artificial hair 30 of yet another color reeled around bobbin 31D is to be selected, ports "3-B" and "4-B" of electromagnetic valve 39*a* in vacuum generator 32 are turned on, and yet another motor for rotation of bobbin 31D is energized. When a sensor, not shown, comprising a photoelectric tube, for example, detects that artificial hair 30 reaches a predetermined length, it is cut by cutter 34. The artificial hair segment 30 of a predetermined length is supplied above base sheet 11, as shown in FIG. 3 and FIGS. 5(A)–5(C).

Artificial hair transplanting operations may be carried out in the following manner. First, base sheet 11 that has been supplied to tensioning/positioning unit 2 is stretched on table 21, as shown in FIGS. 5(A)–5(C), and awaits a supply of artificial hair 30. Table 21 is set to a predetermined position. When the continuous, endless artificial hair 30 is supplied to catcher 44, cylinder 45*c* is actuated so that rods 45*a* move down to a position shown by imaginary lines in FIG. 7 to maintain the stretched condition of base sheet 11. Base sheet 11 has been stretched by unit 2 as described before and remains stretched until a predetermined number of artificial hairs 30 are transplanted and secured to base sheet 11. The continuous, endless artificial hair 30 supported by catcher 44 is cut into a segment of a predetermined length by cutter 34 (FIG. 3), which is then supplied to the stretched base sheet 11.

As shown in FIG. 6(B), artificial hair segment 30 extends through catcher 44 substantially horizontally or in parallel with plane of base sheet 11. Head unit 42 is driven by motor 42*b* to rotate about a vertical axis of post 43. At the same time, motor 49*b* is driven in synchronization with motor 42*b* so that needle shaft 41*e* with needles 41*a*, 41*a* begins to rotate in the same direction with head unit 42. When needles 41*a*, 41*a* are rotated after they catch the intermediate portion 30*a* of artificial hair 30 in a manner described later, a hair whorl is created.

Figure 16:
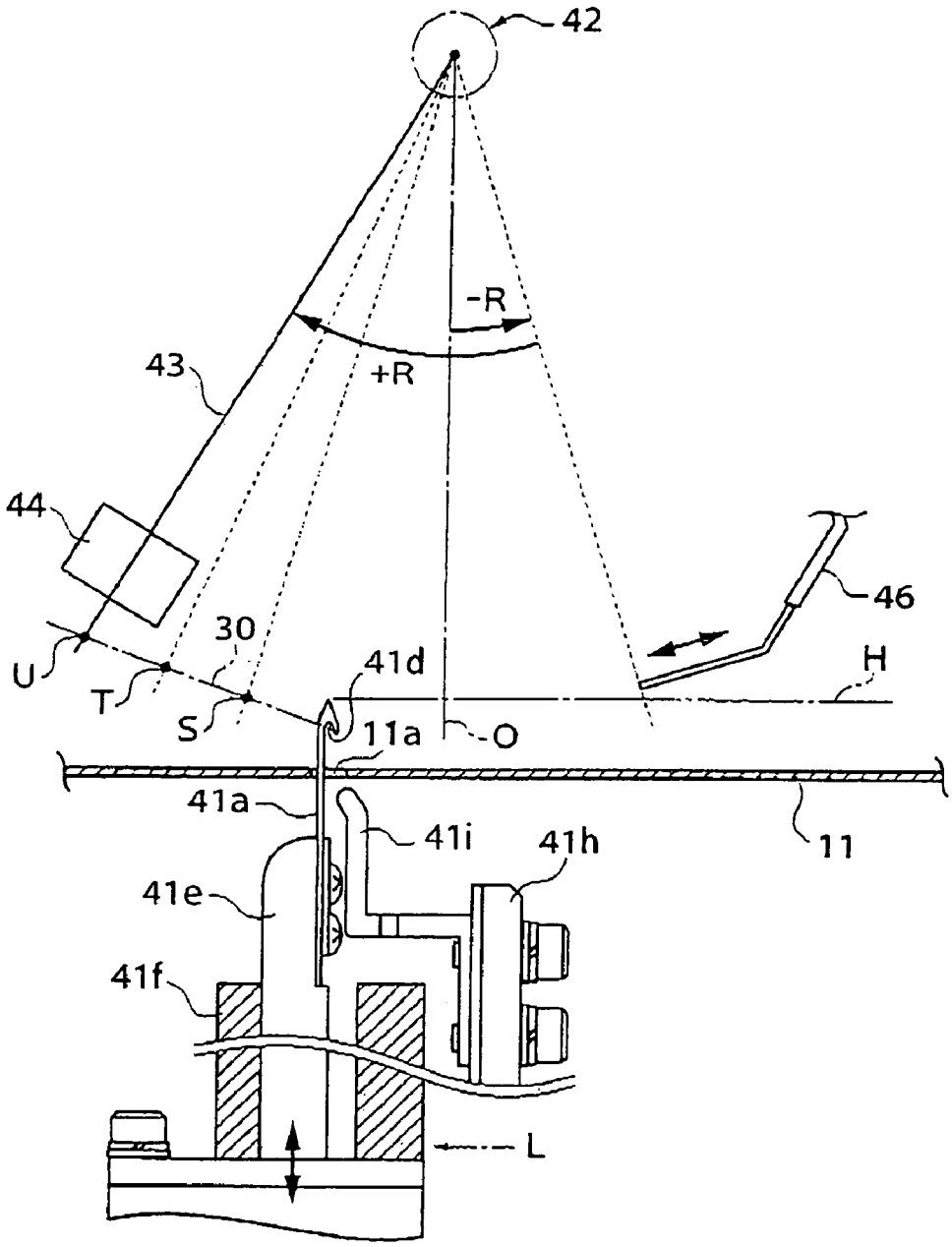
FIG. 16 is a side view showing positional relation between the hair catcher and the heater nozzle, the former swinging and the latter moving in synchronization with the needle reciprocation.

Then, as shown in FIG. 16, head unit 42 is driven by motor 42*a* to swing as a pendulum. Head unit 42 first swings counterclockwise (in FIG. 16) toward a direction indicated by an arrow "−R". The center "O" of swinging movement of head unit 42 is positioned offset from holes 11*a* formed by needles 41*a*, 41*a* when they pierce base sheet 11 during elevation thereof. While head unit 42 swings toward the direction "−R" to separate far from the needle position, needles 41*a*, 41*a* move upward to pierce base sheet 11, and heater nozzle 46 enters between catcher 44 and base sheet 11, as can be best seen in FIGS. 10(A) and (B). Immediately after needles 41*a*, 41*a* reach the upper peel point or level H, motor 42*a* is switched over to swing head unit 42 toward a direction indicated by an arrow "+R". When head unit 42 overruns the center line "O", artificial hair segment 30 extending through catcher 44 is caught by hook end 41*d* of each needle 41*a*. When head unit 42 further swings in the direction "+R" to reach a position indicated by a reference "S", base supporter 41*i* begins to elevate. When head unit 42 still further swings in the direction "+R" to reach a position indicated by a reference "T", needles 41*a*, 41*a* now begin to move down. The amplitude of swinging movement of head unit 42 may be determined optionally within a range of the mechanical maximum amplitude, one of dead points of which is indicated by a reference "U".

Figure 17:
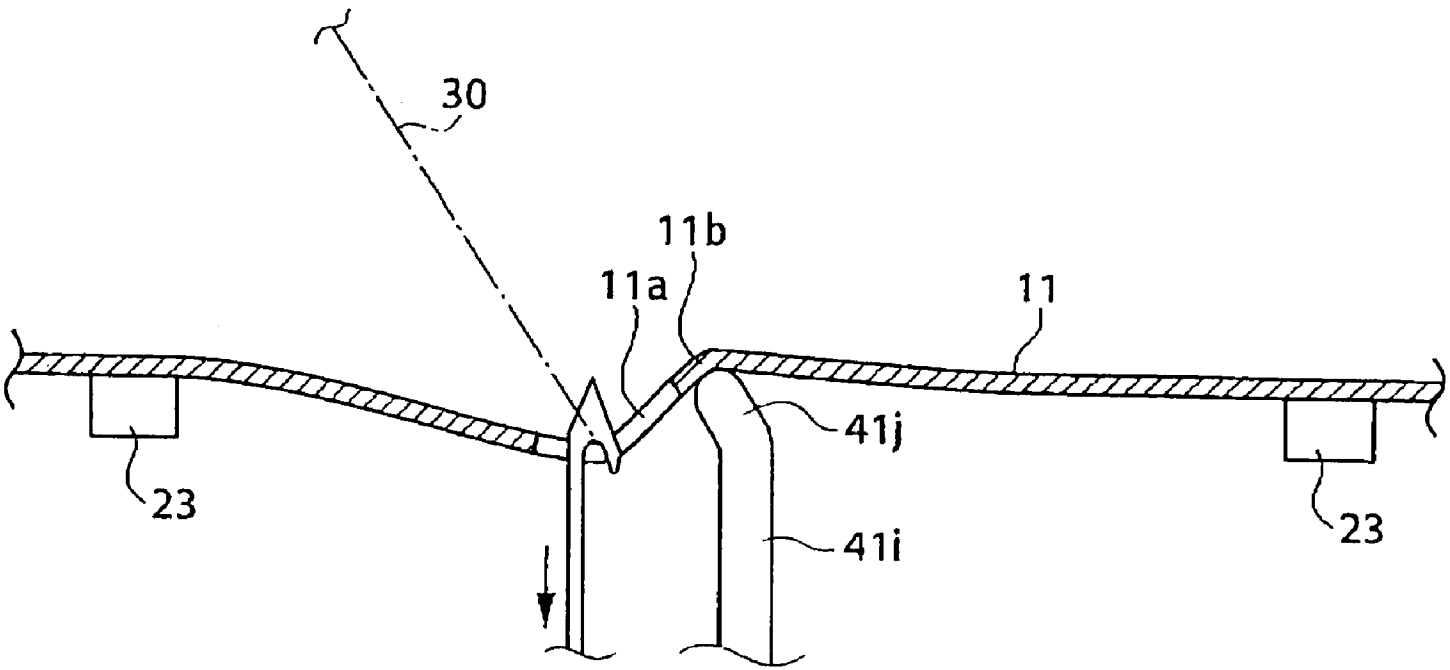
FIG. 17 is an enlarged view showing a base-lifting member used in the apparatus of FIG. 3, which operates in synchronization with reciprocating movement of the needle to lift the base sheet at position adjacent to the hole to allow the needle to pass through the hole during its descent.

Base supporter 41*i* begins to elevate at the time when head unit 42 reaches the position "S" and continues elevating until head unit 42 reaches the position "T". At this time, the upper end 41*j* of base supporter 41*i* urges base sheet 11, more specifically an area 11*b* thereof in vicinity to holes 11*a*, to raise to maintain holes 11*a* unclosed, as best seen in FIG. 17. This allows needles 41*a*, 41*a*, already carrying artificial hair segment 30, to pass through holes 11*a*, without being entangled in base sheet 11, during their downward movement.

Hole 11*a* is formed when needle 41*a* pierces base sheet 11 during its elevation and, accordingly, has an aperture of a very small diameter that corresponds to a diameter of needle 41*a*. After needle 41*a* catches artificial hair segment 30 during its descending movement, it passes through the same hole 11*a*. However, base sheet 11, which is very thin material, tends to intervene downward movement of needle 41*a*. If base sheet 11 should be engaged or hooked by needle hook end 41*d*, the thin base sheet material between holes 11*a*, 11*a* would easily tear off so that these two holes are connected to each other to form a single slit, making it impossible to transplant artificial hair 30 onto base sheet 11. This will be effectively prevented by base supporter 41*i* that compulsorily lifts base sheet 11 to keep hole 11*a* unclosed to a sufficient size for allowing entry and passing of needle 41*a* during its descending movement.

As specifically shown in FIGS. 10(A) and (B), hook ends 41*d*, 41*d* of needles 41*a*, 41*a* engage artificial hair 30 between spaced frames 44A, 44B of catcher 44, while they move down from the upper peak level "H". As needles 41*a*, 41*a* further move down, artificial hair 30 slips out of frames 44A, 44B little by little, as shown in FIG. 10(C), and separates therefrom at last. At the time shown in FIG. 10(C), heater nozzle 46 comes into contact with an intermediate portion of artificial hair 30 which has been engaged by the descending needles 41*a*, 41*a*, thereby forming intermediate turn 30*a*. Then, heating nozzle 46 is moved away toward the stand-by position shown in FIG. 16. Needles 41*a*, 41*a* carrying artificial hair 30 will pass through holes 11*a*, 11*a* which have been enlarged by base supporter 41*i* for smooth and accurate passing of hook ends 41*d*, 41*d* therethrough, as described above in detail.

Accordingly, as shown in FIG. 10(D), when needles 41*a*, 41*a* return to the lower dead point or level L, hair extensions 30*b*, 30*b* have passed through holes 11*a*, 11*a* to beyond the external surface of base sheet 11, while turn 30*a* at the intermediate position thereof remains on the underside of base sheet 11 between holes 11*a*, 11*a*. Thus, artificial hair 30 is interconnected with base sheet 11 at a predetermined point thereon. When a sensor (not shown) detects that the lower end of holder 41*f* reaches a predetermined lower limit position, head unit 42 returns to its original position both in swinging movement and in axial rotation. It is to be noted that, as described before, the intermediate portion of artificial hair 30 is subjected to contact with heater nozzle 46, in the course of the descending movement of needles 41*a*, 41*a* which already engage artificial hair 30, to form turn 30*a* at the intermediate portion thereof, which remains its specific shape, such as the shapes a letter "U".

Then, cylinder 47*a* of repairing liquid supplying unit 47 is actuated to lower nozzle 47*b*, from which the repairing liquid drops onto holes 11*a*, 11*a*. After holes 11*a*, 11*a* have been repaired with the repairing liquid, nozzle 47*b* is retracted to the stand-by position shown in FIG. 7, and rods 45*a* are returned to the upper position shown by solid lines in FIG. 7 to separate away from base sheet 11. Needles 41*a*, 41*a* are oiled to be ready for transplantation of the next artificial hair.

Meanwhile, conveyor 51 is intermittently driven in synchronization with movement of needles 41*a*, 41*a* to rotate in the arrowed direction in FIGS. 11(A) and (B). As conveyor 51 moves in that direction, the transplanted artificial hairs 30 are engaged by bars 52, 53 and, therefore, become oriented to the right. This manner of the artificial hair orientating operation is carried out each time when artificial hair 30 has been transplanted but not secured to base sheet 11, for providing a sufficient space below base sheet 11 to allow needles 41*a*, 41*a* to move up toward base sheet 11 in the next artificial hair transplanting operation.

Artificial hair 30 is secured onto base sheet 11 by means of adhesive applied to turn 30*a*. Application of adhesive to turn 30*a* is carried out by applying drops of the first adhesive toward turn 30 from a conduit, not shown, substantially at the same time when turn 30*a* is formed by heater nozzle 46 or immediately thereafter. At this time, base sheet 11 remains in the stretched condition. The applied adhesive surrounds each turn 30*a* and also enters a gap g (FIG. 1(C)) between turn 30*a* and the underside of base sheet 11, thereby forming the first adhesive layer 111, by which turn 30*a* is fixedly secured to the underside of base sheet 11. A part of the adhesive enters holes 11*a* from the above, which serves to fixedly secure artificial hair 30 to holes 11*a* when the stretched condition of base sheet 11 is released (FIG. 2(B)).

First adhesive layer 111 is formed partially or dotted by applying the first adhesive onto each turn 30*a* of artificial hair 30. This will not affect elasticity of the base sheet material and, therefore, allows sufficient contraction of base sheet 11 when the tension to base sheet 11 is released after application of the first adhesive. The adhesive applied to the stretched base sheet 11 will be adhered to or enter holes 11*a* which remain unclosed, so that, when holes 11*a* are made narrower by releasing the stretched condition, artificial hair 30 is fixedly secured to holes 11*a*. In addition, the first adhesive that has not yet been completely hardened will also contract together with base sheet 11, which increases an amount of adhesive per unit area of base sheet around turn 30*a* and, therefore, improves the bonding strength.

First adhesive layer or swell 111 preferably comprises adhesive having a main ingredient identical to a material of base sheet 11. By way of example, base sheet 11 is made from polyurethane and the adhesive of first adhesive layer 111 comprises polyurethane-base adhesive. When irradiation of ultraviolet rays are applied after the polyurethane-base adhesive has been applied, not only the adhesive is melted but also base sheet 11 of polyurethane is at least partly melted or softened, so that first adhesive layer 111 will be partly merged into base sheet 11, thereby ensuring that artificial hair 30 is fixedly bonded to base sheet 11. This also lowers the height of first adhesive layer 111 and, therefore, reduces the overall thickness of the finished hairpiece.

In the above-described sequential manner, transplantation of one artificial hair 30 (two hairs in appearance) has been completed.

Then, after table 21 is moved by a predetermined pitch "P", for example of 1 mm, in a direction of X or Y (FIG. 14), the same manner of operation is carried out to transplant another artificial hair 30. Movement of table 21 in directions X and Y will be made in a controlled order, so that artificial hairs 30 are transplanted onto base sheet 11 with predetermined pitches "P" in both directions X and Y. The transplanting pitch "P" between adjacent artificial hairs 30 in X and Y directions will depend on the amount of intermittent movement of table 21. The transplanting pitch "P" may be different in the X and Y directions. Also, the transplanting pitch "P" in X and/or Y directions may not be constant, because this could provide favorable appearance just like natural hairs.

The above-described artificial hair transplanting operation is repeated each time table 21 is moved at the predetermined transplanting pitch P until a predetermined number of artificial hairs 30 are transplanted to base sheet 11 and secured by first adhesive layers 111 thereto. After that, the stretched condition of base sheet 11 is removed.

Then, the second adhesive is applied on the entire underside of base sheet 11 to form a second adhesive layer 112, as shown in FIGS. 1(B) and (C)), which completely covers the first adhesive layers 111 and provides a substantially flat surface that is, in turn, covered with separator 113.

Second adhesive layer 112 is made from a so-called "soft" adhesive having a relatively low initial tack. Accordingly, when such adhesive is applied onto the entire underside of base sheet 11 after forming the first adhesive layers 111 at the respective intermediate turns 30*a*, it will slip down from swells of first adhesive layers 111, so that second adhesive layer 112 can be formed as a very thin, but uniformly thick layer with a flat surface, as shown in FIGS. 1(B) and (C).

Since second adhesive layer 112 is formed by transfer, it may entirely overlie the underside of base sheet 11 with a very small, but uniform thickness. Therefore, when the hairpiece is fitted onto a human skin, there is no markable boundary between the base sheet and the human skin, which looks like the user's own hair.

After second adhesive layer 112 is formed to overlie the entire underside of base sheet 11, discharge roller 28 begins rotating to discharge base sheet 11*a* with a predetermined number of artificial hairs 30 transplanted and secured thereto, as shown in FIG. 15(A). Then, another base sheet 11*b* is supplied to tensioning/positioning unit 2 in the manner described before, as shown in FIG. 15(B).

When the hairpiece of the above-described embodiment is fitted onto the human skin, the entire surface of second adhesive layer 112 will be in direct contact with the human skin. Accordingly, even when a tension is applied to any specific point or area of base sheet 11, it could be dispersed over the whole of base sheet 11, which prevents the hairpiece from separating from the human skin.

In the hairpiece manufactured by the apparatus and method of the above-described embodiment, each artificial hair 30 is heated by contact with heater nozzle 46, so that it is transformed and curled such that it has a shape-retainable turn 30*a* at the intermediate portion of artificial hair 30. The shape-retainable turn 30*a* remains on the underside of base sheet 11 after the artificial hair transplanting operation is completed, and is then fixedly secured to the underside of base sheet 11 with first adhesive layers 111. In addition, as described before, the opposite end portions of turn 30*a* are fixedly secured to holes 11*a*, 11*a*. Accordingly, the artificial hairs 30 thus transplanted and secured to base sheet 11 will not lie along the external surface of base sheet 11, but extend in an upstanding orientation with respect to the external surface, which successfully provides a natural appearance when the hairpiece is worn on human skin.

Second adhesive layer 112 formed by transfer of adhesive layer will have a very small and even thickness and provide a smooth, flat surface to be fitted onto human skin. When the hairpiece is fitted onto human skin, it assimilates as a part of the human skin. The hairpiece once fitted remains in position. Anybody can scratch, brush, shampoo or swim, without paying any special care to the fact that he or she really wears the hairpiece. The hairpiece is stuck to the human skin and, therefore, provides a favorable affinity to natural hairs. This means that the hairpiece may suitably be used as a toupee for hiding any bald spot, on the head or on any part of the human skin. No one feels a sense of incongruity because the artificial hairs on the hairpiece could be merged into the surrounding natural hairs. The hairpiece fitted onto the human skin with no gap therebetween will not make an unnatural, echo sound, even when knocked with a fist, for example. By these reasons, a hairpiece wearer is free from any mental stress and unpleasantness.

Most of the conventional wig are of a type wherein a net-like base sheet is capped on a head, for example, and artificial hairs transplanted on the base sheet are mixed up with his or her own hairs. On the contrary, the hairpiece in accordance with the present invention is directly adhered onto the skin via second adhesive layer 112, which can be applied to any part of human skin. No burden is applied to the own hairs, when it is worn or fitted. It may be adhered to hairless private parts.

Artificial hair 30 slips out of opposite frames 44A, 44*b* of catcher 44 during descending movement of needles 41*a*, 41*a* with hook end 41*d* engaging artificial hair 30. It then passes through holes 11*a*, 11*a* together with needle hook ends 41*d*, while intermediate turn or hair root 30*a* remains on the underside of base sheet 11. Artificial hair 30 is disengaged from needle hook ends 41*d* when the needle further moves downward, as shown in FIG. 10(D). This manner of operation makes smooth hair transplantation, with no risk that base sheet 11 could tear off between holes 11*a*, 11*a*.

When artificial hair 30 is engaged by needle hook ends 41*d*, and is to pass through holes 11*a*, 11*a*, it makes contact with heater nozzle 46 which enters between catcher 44 and base sheet 11, which makes sure that the shape-retainable turn 30*a* is formed at the intermediate portion of artificial hair 30. More specifically, along with the descending movement of needles 41*a*, 41*a*, artificial hair 30 entrained by needles 41*a*, 41*a* will first make contact with nozzle 46. Then, intermediate turn 30*a* makes a soft landing on the underside of base sheet 11 after nozzle 46 is moved away. Such dual-phase, moderated movement of artificial hair 30 will reduce the load to be applied to base sheet 11 when turn 30*a* lands on base sheet 11, which prevents tearing-off of base sheet 11 between adjacent holes 11*a*, 11*a*. This is very important when considering that base sheet 11 is an extremely thin sheet.

The intermediate portion of artificial hair 30 is heated by heater nozzle 46 and, therefore, curled or transformed into a predetermined shape with turn 30*a*, which remains on the underside of base sheet 11 as a hair root. Accordingly, artificial hair 30 is securely interconnected to base sheet 11.

Each frame 44A, 44B of catcher 44 has a pair of slanting sides 44*a*, 44*a* connected with each other at the lower apex 44*c*. This assures that artificial hair 30 supplied to interior space 44*d* of frame 44A, 44B is guided along one of slanting sides 44*a*, 44*a* to be finally held at the lower apex 44*c*, resulting in proper positioning of artificial hair 30. In accordance with the present invention, artificial hair 30 is transplanted onto the extremely thin base sheet 11 by means of the extra-fine needles 41*a*, 41*a*. Proper positioning of artificial hair 30 is one of the important factors for achieving an accurate hair transplanting operation.

Before artificial hair 30 is actually transplanted onto base sheet 11, base supporter 41 i moves upward to push up base sheet 11 at an area close to the row of holes 11*a*, 11*a*, so that holes 11*a*, 11*a* remain unclosed (FIG. 17). Base sheet 11 is supported by base supporter 41*i* to prevent the descending needle 41*a* from becoming engaged with base sheet 11. If needle hook end 41*d* should collide against base sheet 11 during the needle descending movement, base sheet 11 could tear off between adjacent two holes 11*a*, 11*a*, making the hair transplantation impossible.

In accordance with the present invention, the artificial hair transplanting pitch "P" can be controlled very precisely to an amount equivalent to the pitch of natural human hairs. This enables mechanization and automation of hairpiece manufacturing. Even in automated manufacturing, there is less probability of producing inferior goods.

It is to be understood that the present invention is not limited to the embodiments described and illustrated herein, but allows various changes, modifications and alterations within a scope of the invention defined in the appended claims.

For example, the base sheet may be made from any material as far as it has a sufficient elasticity to allow expansion when stretched, as well as contraction when the stretched condition is cancelled. The base sheet is stretched by any desired means. Making slack T1, and T2 is favorable but not always necessary.

In the foregoing embodiment, the first adhesive layers are formed while remaining the stretched condition of the base sheet, and the second adhesive layer is formed after the stretched condition is completely removed. However, the second adhesive layer may be formed after not completely removing the stretched condition of the base sheet but loosening the stretched condition. In this case, similar functions and effects may be enjoyed.

The intermediate turn which functions as a hair root may be formed into a desired shape. The rounded turn is shown in the drawings but may be a square one, for example. The shape of the turn depends on the shape of the upper surface of the heater nozzle, when the heater nozzle is used to make contact with the artificial hair to thereby curl the same. Curling the artificial hair may be achieved in other ways as well. For example, the heater nozzle positioned below the supply path of the artificial hair is moved upward so that the intermediate portion of the artificial hair is interposed under pressure between the heater nozzle and an upper stationary member, thereby curling the intermediate portion of the artificial hair to form the turn. In another modification, there is a stationary bar below the supply path of the artificial hair and the heater nozzle is moved downward so that the intermediate portion of the artificial hair is interposed under pressure between the heater nozzle and the bar, thereby curling the intermediate portion of the artificial hair to form the turn. The heater nozzle may be replaced by a cylindrical heater bar wherein its outer periphery may be heated to a predetermined temperature.

Adhesive material forming the first and second adhesive layers may be selected as desired. The artificial hair transplanting operation is carried out by a pair of needles in the illustrated embodiment, but more needles may be employed. The hair segments to be transplanted onto the base sheet may not always be artificial hair, and natural hair may be used. When the artificial hair is used, its material is optional. The hair segment may be supplied to any side of the base sheet. The base sheet may be supplied with its underside down and the hair segment may be supplied to below the base sheet.

The invention claimed is:

1. A hair-transplanting apparatus, comprising:

a first supplying unit for supplying a base sheet of elastic material to a predetermined position;

a base stretching unit for stretching said base sheet at said predetermined position;

a second supplying unit for supplying a hair segment of a predetermined length to a first side of said base sheet;

at least two reciprocating needles with hook ends having an original position below a second side of said base sheet, said needle hook ends piercing said base sheet to form holes and reaching beyond said first side of said base sheet during ascending movement of said needles, said needle hook ends catching an intermediate portion of said hair segment at said first side of said base sheet and then passing down through said holes to reach beyond said second side of said base sheet so that said intermediate portion of said hair segment caught by said hook ends remains on said first side of said base sheet, whereas a pair of lengthwise hair extensions extending from opposite sides of said intermediate portion pass through said holes to below said second side of said base sheet;

a hair-curling unit for giving a shape-retainable turn at said intermediate portion of said hair segment which has been caught by said hook ends of said needle on said first side of said base;

a first adhesive applicator for applying first adhesive to each of said turns of said hair segments remaining on said first side of said base sheet, thereby forming a first adhesive layer each surrounding said turn; and a second adhesive applicator for applying a second adhesive to all over said first side of said base sheet, including said first adhesive layers, to form a second adhesive layer;

said needle, said hair-curling unit and said first adhesive applicator being operable while said base sheet is maintained stretched by said base stretching unit, said stretched condition of said base sheet being released or loosened after a predetermined number of said hair segments are transplanted to said base sheet by said needles and secured thereto by said first adhesive layers, followed by forming said second adhesive layer by said second adhesive applicator.

2. The apparatus according to claim 1, wherein said first supplying unit supplies said base sheet upside down, and said second supplying unit supplies said hair segment to above an underside of said base sheet.

3. The apparatus according to claim 1, wherein said second supplying unit comprises means for supplying a continuous, endless hair material in parallel with said base sheet, and a cutter for cutting said continuous, endless hair material when it is supplied by a predetermined amount, thereby obtaining said hair segment of predetermined length.

4. The apparatus according to claim 1, wherein said second supplying unit comprises a hair catcher including a pair of opposed inverted-triangular frames through which said hair segment extends substantially horizontally, with a space therebetween for allowing insertion of said needle hook ends.

5. The apparatus according to claim 4, wherein said hair catcher is rotatable and swingable about a vertical axis in synchronization with reciprocating movement of said needles.

6. The apparatus according to claim 1, wherein said hair-curling unit comprises a heater operable between said hair segment and said first side of said base sheet, said heater making contact with said intermediate portion of said hair segment when said hair segment carried by said needle hook ends is moved down, whereby said intermediate portion of said hair segment is heated to be partly molten or softened to form said turn of a given shape which remains unchanged after being solidified.

7. The apparatus according to claim 1, wherein said second adhesive applicator applies said second adhesive by adhesive transfer.

8. The apparatus according to claim 1, which further comprises a base lifting member operable in synchronization with said needles for lifting said base sheet, which remains stretched by said base stretching unit, to keep said holes unclosed, thereby allowing smooth entry and passage of said needle hook ends through said holes when said needle hook ends returns to said origins after catching said hair segment.

9. The apparatus according to claim 1, which further comprises a hole repairing unit for injecting repairing liquid to said holes after said needle hook ends carrying said hair segment have separated from said base sheet.

10. A hair-transplanting method comprising the steps of:

stretching a base sheet of elastic material;

moving needles so that their hook ends pierce said base sheet to form holes and reach beyond a first side of said base sheet;

returning said needles to their original position beyond a second side of said base sheet, during which an intermediate portion of said hair segment is caught by said needle hook ends;

transforming said hair segment to provide a shape-retainable turn at said intermediate portion of said hair segment, after said needle hook ends catch said hair segment but before said needle hook ends carrying said hair segment passes through said holes;

forming first adhesive layers of first adhesive in a dot pattern on said first side of said base sheet around said shape-retainable turns to secure said shape-retainable turns onto said first side of said base sheet;

repeating said needle moving step, said needle returning step, said transforming step and said turn-securing step until a predetermined number of said hair segments are transplanted and secured on said base sheet in such manner that said shape-retainable turn at said intermediate portion of said hair segment remains on said first side of said base sheet between said holes whereas a pair of lengthwise hair extensions extends from opposite ends of said shape-returnable turn through said holes to beyond said second side of said base sheet;

releasing or loosening said base sheet from being stretched to contract said base sheet due to its elasticity and reduce diameter of said holes; and applying second adhesive to form a second adhesive layer entirely covering said first side of said base sheet for fitting on human skin.

11. The method according to claim 10, wherein said needle moving step comprises elevating said needles from said original position below said second side of said base sheet, and said needle returning step comprises moving said needles down from their upper dead points toward said original position.

12. The method according to claim 10, wherein said needle moving step comprises moving said needles down from said original position above said second side of said base sheet, and said needle returning step comprises elevating said needles from their lower dead points toward said original position.

13. The method according to claim 10, wherein said first adhesive layer is formed by applying said first adhesive to said shape-retainable turn substantially at the same time or immediately after said transforming step is carried out to form said shape-retainable turn.

14. The method according to claim 10, wherein said first adhesive is formed by applying in advance said first adhesive onto said first side of said base sheet between said holes formed by elevation of said needles, and transferring said first adhesive to said shape-retainable turn when said shape-retainable turn makes contact with said first side of said base sheet during said needle returning step.

15. A hair-transplanted piece, comprising:

a thin base sheet of elastic material;

a predetermined number of hair segments transplanted onto said base sheet in such manner that an intermediate portion of each of said hair segment provides a shape-retainable turn remaining and lying on an underside of said base sheet between a pair of holes whereas a pair of lengthwise hair extensions extending from opposite ends of said turn and passing through said holes to orient hair from an external surface of said base sheet;

first adhesive layers in a dot pattern, each overlapping said turn of said hair segment and securing said same onto said underside of said base sheet; and a second adhesive layer entirely covering said underside of said base sheet, including said first adhesive layers, to provide a flat surface to be fitted onto human skin.

16. The hair-transplanted piece according to claim 13, wherein said base sheet comprises a plane sheet.

17. The hair-transplanted piece according to claim 13, wherein said base sheet is colorless and transparent.

18. The hair-transplanted piece according to claim 13, wherein a main component of said adhesive used to form said first adhesive layer is preferably identical to said base sheet material.

19. The hair-transplanted piece according to claim 13, wherein said base sheet is made from urethane-based material and said adhesive forming said first adhesive layer comprises urethane-based adhesive.

20. The hair-transplanted piece according to claim 13, wherein a main component of said adhesive used to form said second adhesive layer is different from that of said adhesive used to form said first adhesive layer.

21. The hair-transplanted piece according to claim 13, wherein said adhesive used to form said first adhesive layer comprises urethane-based adhesive, whereas said adhesive used to form said second adhesive layer comprises acryl-based adhesive.

22. The hair-transplanted piece according to claim 13, wherein said second adhesive layer is formed by transfer.

* * * * *